US008301361B2

(12) United States Patent
Hashimoto

(10) Patent No.: US 8,301,361 B2
(45) Date of Patent: Oct. 30, 2012

(54) INTERNAL COMBUSTION ENGINE CONTROL SYSTEM

(75) Inventor: Satoshi Hashimoto, Kobe (JP)

(73) Assignee: Mitsubishi Electric Corporation, Tokyo (JP)

( * ) Notice: Subject to any disclaimer, the term of this patent is extended or adjusted under 35 U.S.C. 154(b) by 62 days.

(21) Appl. No.: 12/968,687

(22) Filed: Dec. 15, 2010

(65) Prior Publication Data

US 2011/0303177 A1 Dec. 15, 2011

(30) Foreign Application Priority Data

Jun. 10, 2010 (JP) ..... 2010-132914

(51) Int. Cl.
*F02D 41/06* (2006.01)

(52) U.S. Cl. ..... 701/112; 701/113; 123/179.3; 123/179.4; 123/179.16

(58) Field of Classification Search ..... 701/104, 701/110, 112, 113; 123/179.3, 179.4, 179.16, 123/491, 436, 305
See application file for complete search history.

(56) References Cited

U.S. PATENT DOCUMENTS

| | | | | |
|---|---|---|---|---|
| 7,472,016 | B2 * | 12/2008 | Takeyama et al. | 701/113 |
| 2011/0144891 | A1 * | 6/2011 | Nakamura et al. | 701/104 |
| 2011/0271918 | A1 * | 11/2011 | Nishikiori et al. | 123/90.1 |

FOREIGN PATENT DOCUMENTS

| | | | |
|---|---|---|---|
| JP | 3896640 | A | 12/1998 |
| JP | 4244651 | A | 9/2004 |
| JP | 2005-233622 | A | 9/2005 |
| JP | 2005-256842 | A | 9/2005 |
| JP | 2005-273629 | * | 10/2005 |
| JP | 2005-320945 | A | 11/2005 |
| JP | 2010-31693 | * | 2/2010 |

* cited by examiner

*Primary Examiner* — Hai Huynh
(74) *Attorney, Agent, or Firm* — Sughrue Mion, PLLC

(57) ABSTRACT

Provided is a crank angle detection unit configured to output respective recognition signals from a plurality of intermediate positions each flanked with the positions corresponding to the respective top dead centers of the pistons of a plurality of cylinders and to differentiate the kinds of the respective recognition signals output from the adjacent intermediate positions. Also included is a piston position determination unit that determines the stopping position of the piston when the internal combustion engine stops, based on the crank angle range stored in a crank angle range storage unit and a crank angle corresponding to the position of the recognition signal outputted by the crank angle detection unit. A cylinder to which a fuel is to be initially supplied when the internal combustion engine restarts is determined, based on the stopping position of the piston determined by the piston position determination means.

8 Claims, 15 Drawing Sheets

FIG. 4

WHEN, IMMEDIATELY BEFORE ENGINE STOPS, RECOGNITION SIGNAL 1 OVER CRKNUMS 8 TO 10 IS DETECTED

| RECOGNITION SIGNAL FOUND AFTER RESTART BEGINS | 3 RANGES WITHIN ENGINE STOPPING RANGE | CRANK ANGLE NUMBER WHEN RECOGNITION SIGNAL FOUND [CRKNUM] | CYLINDER TO WHICH FUEL IS INITIALLY SUPPLIED | CYLINDER AT WHICH INITIAL IGNITION CAN BE SET |
|---|---|---|---|---|
| RECOGNITION SIGNAL 1 WITHIN 8 TEETH | RANGE 1 | 10 | #3 | #1 AND #3 |
| RECOGNITION SIGNAL 2 | RANGE 2 | 28 | #3 (RECOGNITION SIGNAL 2 AFTER 9 OR MORE TEETH)<br>#4 (RECOGNITION SIGNAL 2 WITHIN 8 TEETH) | #3 AND #4 |
| RECOGNITION SIGNAL 1 AFTER 9 OR MORE TEETH | RANGE 3 | 46 | #4 | #4 |

FIG. 5

WHEN, IMMEDIATELY BEFORE ENGINE STOPS, RECOGNITION SIGNAL 2 OVER CRKNUMS 25 TO 28 IS DETECTED

| RECOGNITION SIGNAL FOUND AFTER RESTART BEGINS | 3 RANGES WITHIN ENGINE STOPPING RANGE | CRANK ANGLE NUMBER WHEN RECOGNITION SIGNAL FOUND [CRKNUM] | CYLINDER TO WHICH FUEL IS INITIALLY SUPPLIED | CYLINDER AT WHICH INITIAL IGNITION CAN BE SET |
|---|---|---|---|---|
| RECOGNITION SIGNAL 2 WITHIN 7 TEETH | RANGE 1 | 28 | #4 | #3, #4 |
| RECOGNITION SIGNAL 1 | RANGE 2 | 46 | #4 (RECOGNITION SIGNAL 1 AFTER 10 OR MORE TEETH) | #4, #2 |
| | | | #2 (RECOGNITION SIGNAL 1 WITHIN 9 TEETH) | |
| RECOGNITION SIGNAL 2 AFTER 8 OR MORE TEETH | RANGE 3 | 64 | #2 | #2 |

FIG. 6

WHEN, IMMEDIATELY BEFORE ENGINE STOPS, RECOGNITION SIGNAL 1 OVER CRKNUMS 44 TO 46 IS DETECTED

| RECOGNITION SIGNAL FOUND AFTER RESTART BEGINS | 3 RANGES WITHIN ENGINE STOPPING RANGE | CRANK ANGLE NUMBER WHEN RECOGNITION SIGNAL FOUND [CRKNUM] | CYLINDER TO WHICH FUEL IS INITIALLY SUPPLIED | CYLINDER AT WHICH INITIAL IGNITION CAN BE SET |
|---|---|---|---|---|
| RECOGNITION SIGNAL 1 WITHIN 8 TEETH | RANGE 1 | 46 | #2 | #4, #2 |
| RECOGNITION SIGNAL 2 | RANGE 2 | 64 | #2 (RECOGNITION SIGNAL 2 AFTER 9 OR MORE TEETH) | #2, #1 |
| | | | #1 (RECOGNITION SIGNAL 2 WITHIN 8 TEETH) | |
| RECOGNITION SIGNAL 1 AFTER 9 OR MORE TEETH | RANGE 3 | 10 | #1 | #1 |

FIG. 7

WHEN, IMMEDIATELY BEFORE ENGINE STOPS, RECOGNITION SIGNAL 2 OVER CRKNUMS 61 TO 64 IS DETECTED

| RECOGNITION SIGNAL FOUND AFTER RESTART BEGINS | 3 RANGES WITHIN ENGINE STOPPING RANGE | CRANK ANGLE NUMBER WHEN RECOGNITION SIGNAL FOUND [CRKNUM] | CYLINDER TO WHICH FUEL IS INITIALLY SUPPLIED | CYLINDER AT WHICH INITIAL IGNITION CAN BE SET |
|---|---|---|---|---|
| RECOGNITION SIGNAL 2 WITHIN 7 TEETH | RANGE 1 | 64 | #1 | #2, #1 |
| RECOGNITION SIGNAL 1 | RANGE 2 | 10 | #1 (RECOGNITION SIGNAL 1 AFTER 10 OR MORE TEETH) | #1, #3 |
| | | | #3 (RECOGNITION SIGNAL 1 WITHIN 9 TEETH) | |
| RECOGNITION SIGNAL 2 AFTER 8 OR MORE TEETH | RANGE 3 | 28 | #3 | #3 |

FIG. 12

WHEN, IMMEDIATELY BEFORE ENGINE STOPS, RECOGNITION SIGNAL 1 OVER CRKNUMS 5 TO 7 IS DETECTED

| RECOGNITION SIGNAL FOUND AFTER RESTART BEGINS | 3 RANGES WITHIN ENGINE STOPPING RANGE | CRANK ANGLE NUMBER WHEN RECOGNITION SIGNAL FOUND [CRKNUM] | CYLINDER TO WHICH FUEL IS INITIALLY SUPPLIED | CYLINDER AT WHICH INITIAL IGNITION CAN BE SET |
|---|---|---|---|---|
| RECOGNITION SIGNAL 1 | RANGE 1 | 7 | #2, #3 | #1 to #3 |
| RECOGNITION SIGNAL 2 | RANGE 2 | 19 | #3 (RECOGNITION SIGNAL 2 AFTER 6 OR MORE TEETH) | #2 to #4 |
| | | | #3, #4 (RECOGNITION SIGNAL 2 WITHIN 5 TEETH) | |
| RECOGNITION SIGNAL 3 | RANGE 3 | 31 | #4 | #3 to #4 |

FIG. 13

WHEN, IMMEDIATELY BEFORE ENGINE STOPS, RECOGNITION SIGNAL 2 OVER CRKNUMS 16 TO 19 IS DETECTED

| RECOGNITION SIGNAL FOUND AFTER RESTART BEGINS | 3 RANGES WITHIN ENGINE STOPPING RANGE | CRANK ANGLE NUMBER WHEN RECOGNITION SIGNAL FOUND [CRKNUM] | CYLINDER TO WHICH FUEL IS INITIALLY SUPPLIED | CYLINDER AT WHICH INITIAL IGNITION CAN BE SET |
|---|---|---|---|---|
| RECOGNITION SIGNAL 2 | RANGE 1 | 19 | #3, #4 | #2 to #4 |
| RECOGNITION SIGNAL 3 | RANGE 2 | 31 | #4 (RECOGNITION SIGNAL 3 AFTER 5 OR MORE TEETH) | #3 to #5 |
| | | | #4, #5 (RECOGNITION SIGNAL 3 WITHIN 4 TEETH) | |
| RECOGNITION SIGNAL 1 | RANGE 3 | 43 | #5 | #4 to #5 |

FIG. 14

WHEN, IMMEDIATELY BEFORE ENGINE STOPS, RECOGNITION SIGNAL 3 OVER CRKNUMS 27 TO 31 IS DETECTED

| RECOGNITION SIGNAL FOUND AFTER RESTART BEGINS | 3 RANGES WITHIN ENGINE STOPPING RANGE | CRANK ANGLE NUMBER WHEN RECOGNITION SIGNAL FOUND [CRKNUM] | CYLINDER TO WHICH FUEL IS INITIALLY SUPPLIED | CYLINDER AT WHICH INITIAL IGNITION CAN BE SET |
|---|---|---|---|---|
| RECOGNITION SIGNAL 3 | RANGE 1 | 31 | #4, #5 | #3 to #5 |
| RECOGNITION SIGNAL 1 | RANGE 2 | 43 | #5 (RECOGNITION SIGNAL 1 AFTER 7 OR MORE TEETH) | #4 to #6 |
| | | | #5, #6 (RECOGNITION SIGNAL 1 WITHIN 6 TEETH) | |
| RECOGNITION SIGNAL 2 | RANGE 3 | 55 | #6 | #5 to #6 |

FIG. 15

WHEN, IMMEDIATELY BEFORE ENGINE STOPS, RECOGNITION SIGNAL 1 OVER CRKNUMS 41 TO 43 IS DETECTED

| RECOGNITION SIGNAL FOUND AFTER RESTART BEGINS | 3 RANGES WITHIN ENGINE STOPPING RANGE | CRANK ANGLE NUMBER WHEN RECOGNITION SIGNAL FOUND [CRKNUM] | CYLINDER TO WHICH FUEL IS INITIALLY SUPPLIED | CYLINDER AT WHICH INITIAL IGNITION CAN BE SET |
|---|---|---|---|---|
| RECOGNITION SIGNAL 1 | RANGE 1 | 43 | #5, #6 | #4 to #6 |
| RECOGNITION SIGNAL 2 | RANGE 2 | 55 | #6 (RECOGNITION SIGNAL 2 AFTER 6 OR MORE TEETH) | #5 to #6, #1 |
| | | | #6, #1 (RECOGNITION SIGNAL 2 WITHIN 5 TEETH) | |
| RECOGNITION SIGNAL 3 | RANGE 3 | 67 | #1 | #6, #1 |

FIG. 16

WHEN, IMMEDIATELY BEFORE ENGINE STOPS, RECOGNITION SIGNAL 2 OVER CRKNUMS 52 TO 55 IS DETECTED

| RECOGNITION SIGNAL FOUND AFTER RESTART BEGINS | 3 RANGES WITHIN ENGINE STOPPING RANGE | CRANK ANGLE NUMBER WHEN RECOGNITION SIGNAL FOUND [CRKNUM] | CYLINDER TO WHICH FUEL IS INITIALLY SUPPLIED | CYLINDER AT WHICH INITIAL IGNITION CAN BE SET |
|---|---|---|---|---|
| RECOGNITION SIGNAL 2 | RANGE 1 | 55 | #6, #1 | #5 to #6, #1 |
| RECOGNITION SIGNAL 3 | RANGE 2 | 67 | #1 (RECOGNITION SIGNAL 3 AFTER 5 OR MORE TEETH) | #6, #1 to #2 |
| | | | #1, #2 (RECOGNITION SIGNAL 3 WITHIN 4 TEETH) | |
| RECOGNITION SIGNAL 1 | RANGE 3 | 7 | #2 | #1 to #2 |

FIG.17

WHEN, IMMEDIATELY BEFORE ENGINE STOPS, RECOGNITION SIGNAL 3 OVER CRKNUMS 63 TO 67 IS DETECTED

| RECOGNITION SIGNAL FOUND AFTER RESTART BEGINS | 3 RANGES WITHIN ENGINE STOPPING RANGE | CRANK ANGLE NUMBER WHEN RECOGNITION SIGNAL FOUND [CRKNUM] | CYLINDER TO WHICH FUEL IS INITIALLY SUPPLIED | CYLINDER AT WHICH INITIAL IGNITION CAN BE SET |
|---|---|---|---|---|
| RECOGNITION SIGNAL 3 | RANGE 1 | 67 | #1, #2 | #6, #1 to #2 |
| RECOGNITION SIGNAL 1 | RANGE 2 | 7 | #2 (RECOGNITION SIGNAL 1 AFTER 7 OR MORE TEETH) | #1 to #3 |
| | | | #2, #3 (RECOGNITION SIGNAL 1 WITHIN 6 TEETH) | |
| RECOGNITION SIGNAL 2 | RANGE 3 | 19 | #3 | #2 to #3 |

INTERNAL COMBUSTION ENGINE CONTROL SYSTEM

BACKGROUND OF THE INVENTION

1. Field of the Invention

The present invention relates to an internal combustion engine control system that controls an internal combustion engine, and particularly to an internal combustion engine control system that controls an internal combustion engine by utilizing a crank angle sensor so as to localize the position of a piston of the internal combustion engine.

2. Description of the Related Art

To date, for example, with regard to an idling stop vehicle, there has been provided a system in which, when an engine is restarted after the internal combustion engine (referred to as an engine, hereinafter) is stopped through an idling stop method, the position of a piston is determined by use of a piston position determination method the same as that utilized at a time when the engine is normally started, and based on the determined piston stopping position, fuel injection control is performed sequentially from the initial stage of the restarting of the engine.

However, in the case of such a conventional system, when an engine is restarted after the engine is stopped through the idling stop method, there is utilized the piston position determination method the same as that utilized at a time when the engine is normally started; thus, there has been a problem that it takes a lot of time to restart the engine after the engine is stopped through the idling stop method.

Accordingly, there has been proposed a system (e.g., refer to Japanese Patent Application Laid-Open No. H7-83093) in which there is stored the position of a piston at a time when the engine is stopped through the idling stop method, and when the engine is restarted, the stored piston position is utilized so that there is reduced the time for determining the piston position.

Moreover, there has been proposed a system (e.g., refer to Japanese Patent No. 3896640) in which, by controlling an apparatus such as an engine load or an auxiliary apparatus when an engine is stopped, a piston of the engine is stopped at the target position.

Furthermore, to date, there has been proposed a system (e.g., refer to Japanese Patent No. 4244651) in which, in the process of stopping an engine, the engine stopping position, i.e., the piston stopping position is estimated based on a parameter for representing the movement of the engine and a parameter for preventing the movement of the engine.

Still moreover, to date, there has been proposed a system (e.g., refer to Japanese Patent Application Laid-Open No. 2005-233622 and Japanese Patent Application Laid-Open No. 2005-256842) in which, in order to accurately determine the piston position at a time when the engine is stopped, there is utilized a sensor that enables a crank angle to be accurately detected even when the crank shaft reverses at a time when the engine is stopped.

However, in the case of the conventional system disclosed in Japanese Patent Application Laid-Open No. H7-83093, measures for a rebound (reversal) at a time an engine is stopped is insufficient; thus, the engine stopping position may not accurately be stored.

Moreover, in the case of the conventional system disclosed in Japanese Patent No. 3896640, it is required to control an apparatus such as a load or an auxiliary apparatus for making an engine stop at the target position; therefore, control becomes complicated, and when the apparatus such as a load or an auxiliary apparatus is changed, it is required to change the contents of the control.

Still moreover, in the case of the conventional system disclosed in Japanese Patent No. 4244651, it is complicated to perform calculation by utilizing a parameter for representing the movement of an engine and a parameter for preventing the movement of the engine, and at the same time, the parameter inherent to the engine needs to be obtained through a physical model or experimental data; thus, there is also required an expensive calculation device for utilizing the physical model.

Furthermore, in the case of the conventional system disclosed in Japanese Patent Application Laid-Open No. 2005-233622 and Japanese Patent Application Laid-Open No. 2005-256842, a crank angle sensor having a reversal detection function is utilized; therefore, the cost is raised compared with the case where an ordinary crank angle sensor is utilized. Even in the case where an encoder that directly outputs an accurate angle is utilized as a crank angle sensor, the encoder itself is expensive; at the same time, there is also required an expensive calculation device for decoding the output signal of the encoder.

SUMMARY OF THE INVENTION

The present invention has been implemented in order to solve the problems in the foregoing conventional systems; the objective thereof is to provide an internal combustion engine control system that requires simple control and calculation, that can be applied to internal combustion engines, the number of cylinders of which are different, and that is inexpensive.

An internal combustion engine control system according to the present invention is provided with a crank angle detection means that outputs a crank angle signal corresponding to a crank angle of an internal combustion engine having a plurality of cylinders; a crank angle range storage means that stores a crank angle range at a time when the internal combustion engine stops, based on the crank angle signal; and a piston position determination means that determines the piston positions of the plurality of cylinders, based on the crank angle signal. The crank angle detection means has a function of outputting respective recognition signals from a plurality of intermediate positions each flanked with the positions corresponding to the respective top dead centers of the pistons of the plurality of cylinders and differentiates the kinds of the respective recognition signals outputted from the adjacent intermediate positions; the piston position determination means determines the stopping position of the piston at a time when the internal combustion engine stops, based on the crank angle range stored in the crank angle range storage means and the crank angle corresponding to the position of the recognition signal outputted by the crank angle detection means; and there is determined the cylinder to which a fuel is to be initially supplied when the internal combustion engine restarts, based on the stopping position of the piston determined by the piston position determination means.

An internal combustion engine control system according to the present invention requires simple control and calculation, can be applied to internal combustion engines, the number of cylinders of which are different, and allows an inexpensive crank angle sensor, which is similar to a conventional sensor, to be utilized; thus, the piston position at a time when an internal combustion engine restarts can be determined readily and inexpensively, whereby ignition can securely be implemented at a cylinder to which a fuel is initially supplied and the internal combustion engine can rapidly be restarted.

The foregoing and other object, features, aspects, and advantages of the present invention will become more apparent from the following detailed description of the present invention when taken in conjunction with the accompanying drawings.

BRIEF DESCRIPTION OF THE DRAWINGS

FIG. 4 is an explanatory table for explaining the operation of an internal combustion engine control system according to Embodiment 1 of the present invention;

FIG. 5 is an explanatory table for explaining the operation of an internal combustion engine control system according to Embodiment 1 of the present invention;

FIG. 6 is an explanatory table for explaining the operation of an internal combustion engine control system according to Embodiment 1 of the present invention;

FIG. 7 is an explanatory table for explaining the operation of an internal combustion engine control system according to Embodiment 1 of the present invention;

FIG. 12 is an explanatory table for explaining the operation of an internal combustion engine control system according to Embodiment 2 of the present invention;

FIG. 13 is an explanatory table for explaining the operation of an internal combustion engine control system according to Embodiment 2 of the present invention;

FIG. 14 is an explanatory table for explaining the operation of an internal combustion engine control system according to Embodiment 2 of the present invention;

FIG. 15 is an explanatory table for explaining the operation of an internal combustion engine control system according to Embodiment 2 of the present invention;

FIG. 16 is an explanatory table for explaining the operation of an internal combustion engine control system according to Embodiment 2 of the present invention; and FIG. 17 is an explanatory table for explaining the operation of an internal combustion engine control system according to Embodiment 2 of the present invention.

DETAILED DESCRIPTION OF THE PREFERRED EMBODIMENTS

Embodiment 1

Figure 1:
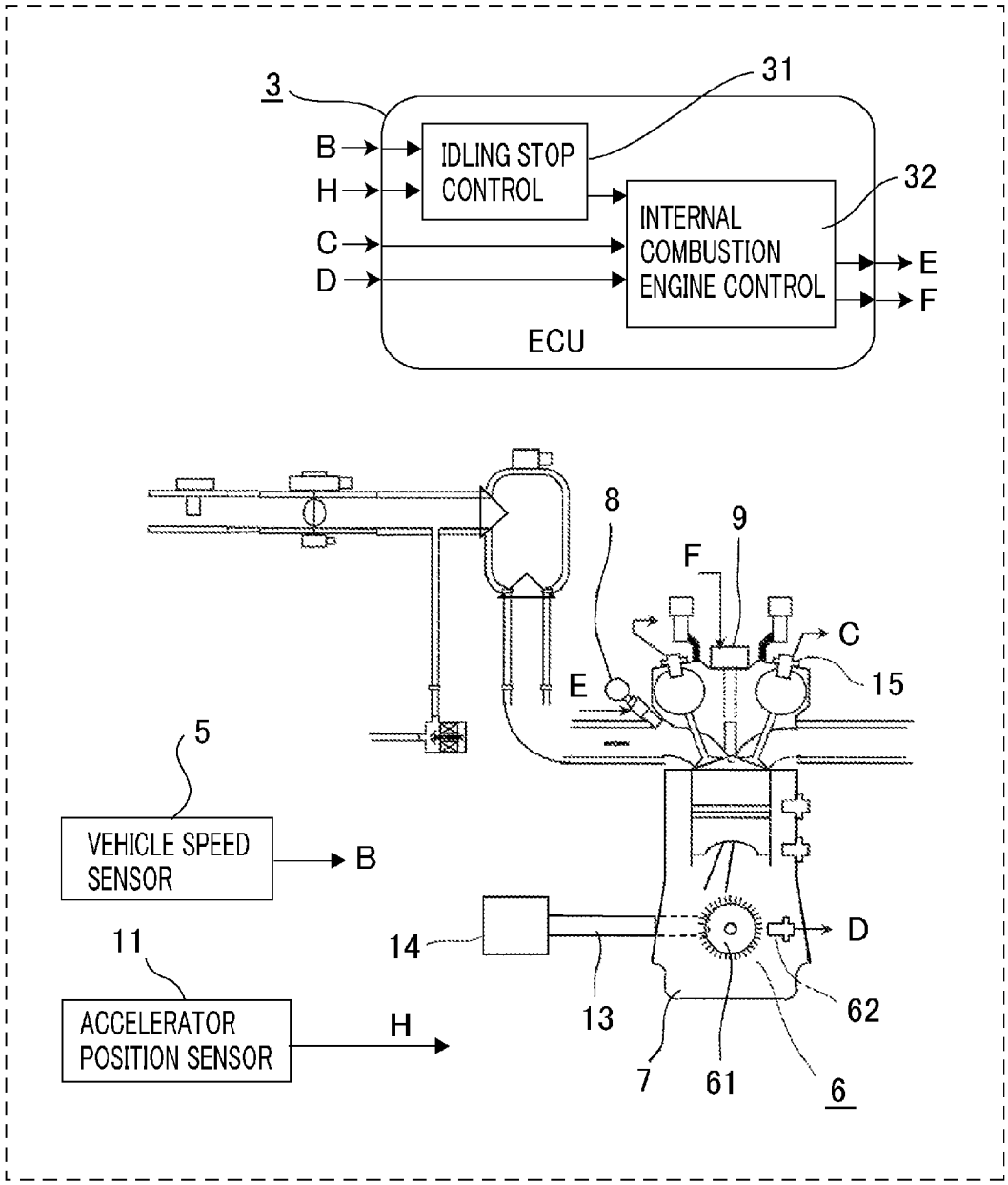
FIG. 1 is an explanatory diagram illustrating the overall configuration of an internal combustion engine control system according to Embodiment 1 of the present invention, along with an internal combustion engine.

Hereinafter, an internal combustion engine control system according to Embodiment 1 of the present invention will be explained with reference to the drawings. FIG. 1 is an explanatory diagram illustrating the overall configuration of an internal combustion engine control system according to Embodiment 1 of the present invention, along with an internal combustion engine; the internal combustion engine control system illustrated in FIG. 1 is applied to a 4-cylinder and 4-stroke engine.

In FIG. 1, an idling stop control apparatus 3 provided in an engine control unit (referred to as an ECU, hereinafter) includes a microcomputer and the like, has an idling stop control unit 31 and an internal combustion engine control unit 32, and electronically controls an engine 7. A speed sensor 5 measures the speed of a reference vehicle, generates a vehicle speed signal B corresponding to the measured speed, and inputs the vehicle speed signal B to the idling stop control apparatus 3. Although not illustrated, the idling stop control apparatus 3 is provided with a crank angle range storage means that stores a crank angle range at a time when the internal combustion engine is stopped, based on a crank angle signal, described later; and a piston position determination means that determines the piston positions of a plurality of cylinders, based on the crank angle signal.

A crank angle sensor 6 is provided with a signal rotor 61 that rotates along with a crankshaft 13 of the engine 7 and a magnetic detection unit 62 that opposes the outer circumference of the signal rotor 61 across a gap. As described later, the signal rotor 61 has a plurality of teeth, formed of magnetic materials, that are provided on the outer circumference thereof in such a way as to be spaced apart from one another by a predetermined gap. The magnetic detection unit 62 converts a magnetic change, produced when the teeth of the signal rotor 61 pass through the opposing gap, into an electric signal, generates a crank angle signal D corresponding to a crankshaft rotation angle (referred to as a crank angle, hereinafter), and inputs the crank angle signal D to the idling stop control apparatus 3.

Four respective injectors 8 provided in four cylinders #1, #2, #3, and #4, described later, each inject a predetermined amount of fuel into an intake manifold at a predetermined timing. Four respective ignition plugs 9 provided in the four cylinders #1, #2, #3, and #4 each ignite the fuel in the combustion chamber of the cylinder at a predetermined timing so as to burn the fuel.

An accelerator position sensor 11 detects an accelerator opening degree corresponding to diver's depression of the accelerator pedal, generates an accelerator opening degree signal H corresponding to the detected accelerator opening degree, and inputs the accelerator opening degree signal H to the idling stop control apparatus 3. A motor 14 is directly connected with the crankshaft 13. A cam angle sensor 15 detects the rotation angle of a cam that drives the intake valve and the exhaust valve of each cylinder of the engine 7, generates a cam angle signal C corresponding to the detected cam angle, and inputs the cam angle signal C to the idling stop control apparatus 3.

Based on inputted signals and the like, such as the vehicle speed signal B, an accelerator position signal H, the cam angle signal C, and the crank angle signal D, from the sensors, the idling stop control apparatus 3 calculates and outputs an injector drive signal E and an ignition plug drive signal F.

Based on the injector drive signal E from the idling stop control apparatus 3, an actuator for driving the injector 8 drives the corresponding injector 8 so as to make the injector 8 inject a predetermined amount of fuel at a predetermined timing. Based on the ignition plug drive signal F from the idling stop control apparatus 3, an ignition apparatus for driving the ignition plug 9 is driven so as to make the ignition plug 9 produce a spark discharge at a predetermined timing.

Figure 2:
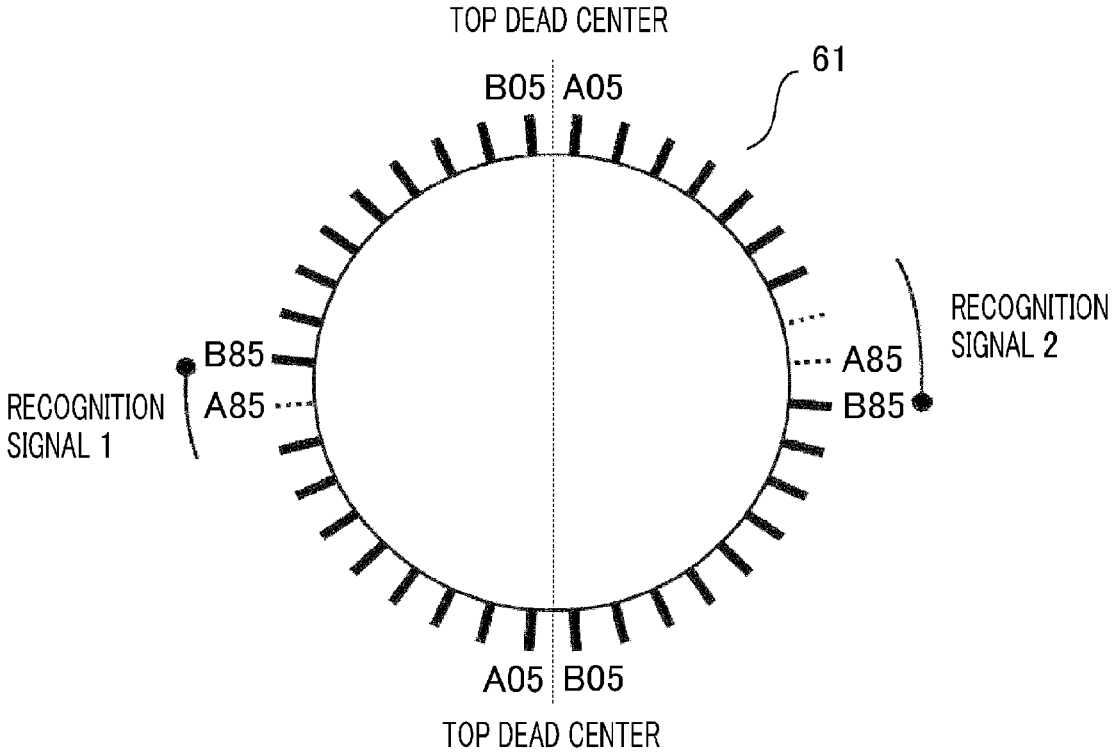
FIG. 2 is an explanatory chart representing the configuration of the signal rotor of a crank angle sensor in an internal combustion engine control system according to Embodiment 1 of the present invention.

Next, the configuration of the crank angle sensor 6 will be explained. FIG. 2 is an explanatory chart representing the configuration of the signal rotor of the crank angle sensor in the internal combustion engine control system according to Embodiment 1 of the present invention. In FIG. 2, the signal rotor 61 is configured in such a way as to generate recognition signals; the number of the recognition signals corresponds to the maximum prime number among the divisors of the number of engine cylinders. In the case of Embodiment 1, the number of engine cylinders is "4", and the maximum prime number out of the divisors of "4" is "2"; thus, the signal rotor 61 is configured in such a way as to generate two kinds of recognition signals 1 and 2; the number of the recognition signals corresponds to the maximum prime number "2".

The configuration of the signal rotor 61 will be described further in detail; on the outer circumference thereof, the signal rotor 61 is provided with 33 teeth (illustrated with solid lines) formed of magnetic materials. These 33 teeth are provided at 33 positions among 36 positions obtained by equally dividing the outer circumference of the signal rotor 61 in steps of 10° with respect to the center axis of the signal rotor 61. Among the 36 positions on the outer circumference of the signal rotor 61, the rest 3 are the positions for missing teeth (illustrated with broken lines) where no tooth exists.

In the case of 4-cylinder and 4-stroke engine, the respective pistons of the 4 cylinders are each configured in such a way as to sequentially reach the top dead center at the crank angle 180° CA, 360° CA, 540° CA, and 720° CA. Accordingly, on the outer circumference of the signal rotor 61, positions corresponding to the piston top dead centers are set in such a way as to be spaced apart from each other by 180°; teeth B05 and A05 are disposed in such a way as to flank each of the two positions corresponding to the top dead centers. These two positions, on the signal rotor 61, corresponding to the top dead centers correspond to the respective piston top dead centers of two cylinders; the details thereof will be described later with reference to FIG. 3.

It is assumed that A05 designates the tooth situated at the left side of the position corresponding to the bottommost top dead center in FIG. 2, and A85 designates the missing tooth situated at the position that is the 9th position from the bottommost top dead center when being counted clockwise including the tooth A05. Moreover, it is assumed that B85 designates the tooth situated at the next position of the missing tooth A85, and B05 designates the tooth situated at the position that is the 9th position from the missing tooth A85 when being counted clockwise including the tooth B85. Furthermore, the tooth following the tooth B05 is designated by A05, and the teeth situated at the positions that are the 8th and 9th positions from the tooth B05 when being counted clockwise including the tooth A05 are missing teeth; the missing tooth situated at that 9th position is designated by A85. In addition, it is assumed that B85 designates the tooth situated at the next position of the missing tooth A85, and B05 designates the tooth situated at the position that is the 9th position from the missing tooth A85 when being counted clockwise including the tooth B85.

Here, the recognition signal 1 is formed of the left-hand missing tooth A85 in FIG. 2 and the two teeth (one of them is the tooth B85) that flank the missing tooth A85. The recognition signal 2 is formed of the right-hand missing tooth A85 in FIG. 2, the tooth that is 2 positions before the missing tooth A85, the missing tooth immediately before the missing tooth A85, and the tooth immediately after the missing tooth A85. As described above, in the case of Embodiment 1, two kinds of recognition signals, i.e., the recognition signal 1 and the recognition signal 2 are formed.

As illustrated in FIG. 2, the recognition signal 1 and the recognition signal 2 are set at the positions that are spaced 180° apart from each other with respect to the center axis of the signal rotor 61. As described later, the recognition signal 1 and the recognition signal 2 are set in order to determine the respective piston positions of four cylinders, based on the crank angle signal D.

In Embodiment 1, by providing positions for missing teeth, the recognition signal 1 and the recognition signal 2 are formed; however, any other method may be adopted as long as setting is made in such a way that the recognition signal 1 and the recognition signal 2 can be outputted.

Figure 3:
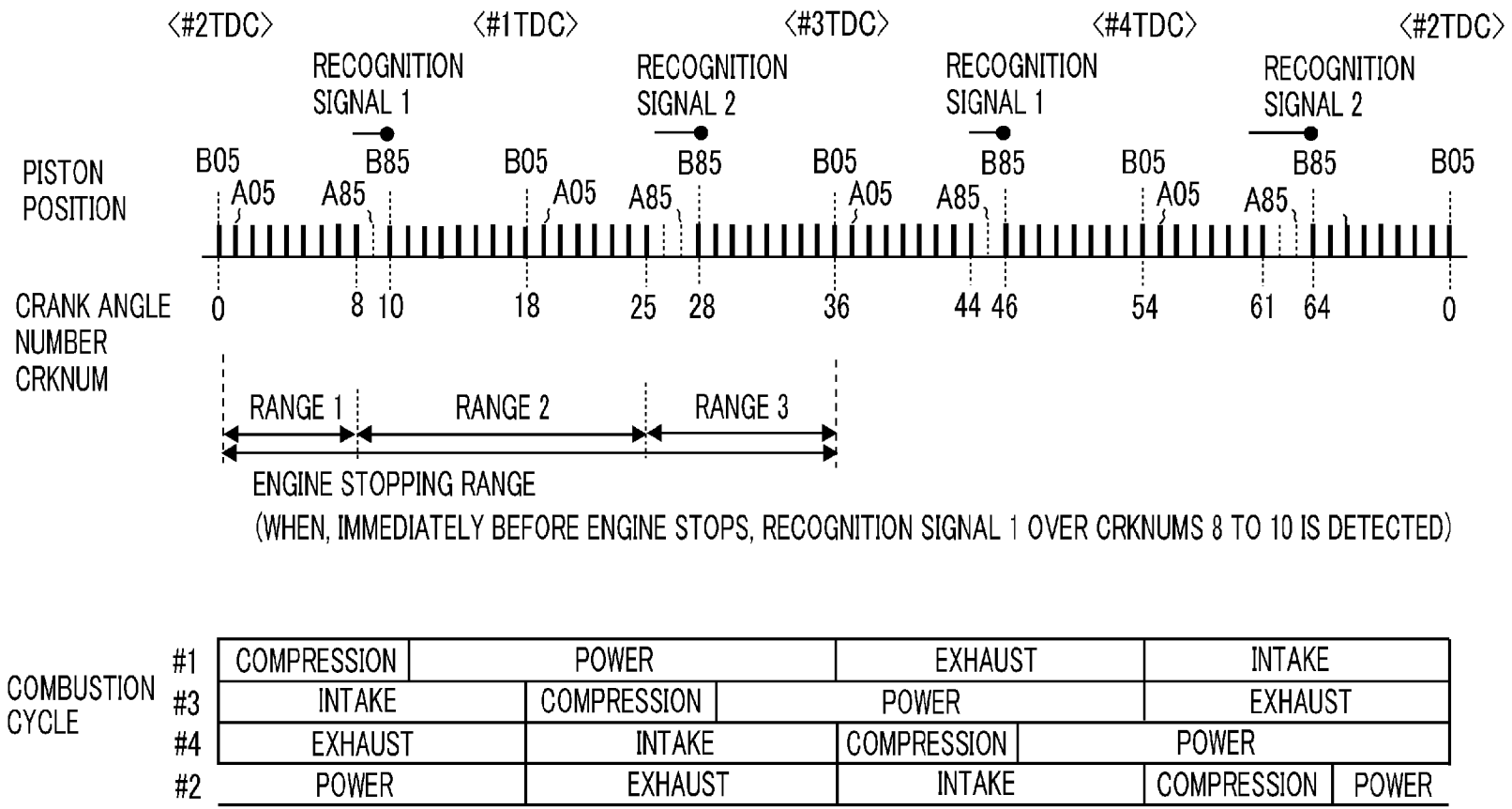
FIG. 3 is an explanatory chart representing the waveform of the output of a crank angle sensor in an internal combustion engine control system according to Embodiment 1 of the present invention, as well as the relationship between the engine stopping range and the combustion cycle.

FIG. 3 is an explanatory chart representing the waveform of the output of a crank angle sensor in an internal combustion engine control system according to Embodiment 1 of the present invention, as well as the relationship between the engine stopping range and the combustion cycle. In FIG. 3, the waveform of the crank angle signal is the waveform of a signal that is outputted from the magnetic detection unit 62 when the signal rotor 61 of the crank angle sensor represented in FIG. 2 rotates counterclockwise in synchronization with the rotation of the crankshaft 13; by use of the same reference characters as those of the teeth or the missing teeth of the signal rotor 61, there are represented the waveforms of the crank angle signals that are produced in accordance with the positions on the signal rotor 61 in FIG. 2, i.e., in accordance with the bottommost right-hand tooth B05, as the starting position, the tooth A05, - - - , A85, B85, - - - , B05, A05, - - - , A85, B85, - - - , and B05, in that order.

In Embodiment 1, the engine 7 is provided with four cylinders, i.e., a cylinder 1, a cylinder 2, a cylinder 3, and a cylinder 4; reference characters #1, #2, #3, and #4 denote the cylinder 1, the cylinder 2, the cylinder 3, and the cylinder 4, respectively. In each of the cylinders #1, #2, #3, and #4, the crank angle 720° CA, i.e., two rotations of the crankshaft 13 correspond to a single cycle consisting of an "intake" stroke, a "compression" stroke, a "combustion" stroke, and an "exhaust" stroke.

In FIG. 3, the crank angle number CRKNUM (equivalent to the crank angle CA, and referred to as a crank angle number CRKNUM, hereinafter) corresponding to the crank angle signal B05 at the starting position is "0"; the crank angle number CRKNUM corresponding to the next crank angle signal A05 is "1"; the crank angle numbers CRKNUMs corresponding to the crank angle signals, which are sequentially produced thereafter, are "2", "3", - - - , "71"; at last, returning to the crank angle signal B05 at the starting position, the crank angle number CRKNUM is "0".

Accordingly, as represented in FIG. 3, the recognition signal 1 is generated in accordance with the crank angle numbers CRKNUMs "8", "9", and "10", while the crankshaft 13 rotates twice; next, the recognition signal 2 is generated in accordance with the crank angle numbers CRKNUMs "25", "26", and "28"; next, the recognition signal 1 is generated in accordance with the crank angle numbers CRKNUMs "44", "45", and "46"; next, the recognition signal 2 is generated in accordance with the crank angle numbers CRKNUMs "61", "62", "63", and "64".

The piston of the cylinder #2 reaches the top dead center #2TDC when the crank angle number CRKNUM is "0"; the piston of the cylinder #1 reaches the top dead center #1TDC when the crank angle number CRKNUM is "18"; the piston of the cylinder #3 reaches the top dead center #3TDC when the crank angle number CRKNUM is "36"; the piston of the cylinder #4 reaches the top dead center #4TDC when the crank angle number CRKNUM is "54".

As represented in FIG. 3, in the cylinder #1, the interval between the crank angle number CRKNUM "0" and the crank angle number CRKNUM "11" corresponds to the compression stroke; the interval between the crank angle number CRKNUM "11" and the crank angle number CRKNUM "36" corresponds to the power stroke; the interval between the crank angle number CRKNUM "36" and the crank angle number CRKNUM "54" corresponds to the exhaust stroke; the interval between the crank angle number CRKNUM "54" and the crank angle number CRKNUM "0" corresponds to the intake stroke.

In the cylinder #3, the interval between the crank angle number CRKNUM "0" and the crank angle number CRKNUM "18" corresponds to the intake stroke; the interval between the crank angle number CRKNUM "18" and the crank angle number CRKNUM "29" corresponds to the compression stroke; the interval between the crank angle number CRKNUM "29" and the crank angle number CRKNUM "54" corresponds to the power stroke; the interval between the crank angle number CRKNUM "54" and the crank angle number CRKNUM "0" corresponds to the exhaust stroke.

In the cylinder #4, the interval between the crank angle number CRKNUM "0" and the crank angle number CRKNUM "18" corresponds to the exhaust stroke; the interval between the crank angle number CRKNUM "18" and the crank angle number CRKNUM "36" corresponds to the intake stroke; the interval between the crank angle number CRKNUM "36" and the crank angle number CRKNUM "47" corresponds to the compression stroke; the interval between the crank angle number CRKNUM "47" and the crank angle number CRKNUM "0" corresponds to the power stroke.

In the cylinder #2, the interval between the crank angle number CRKNUM "18" and the crank angle number CRKNUM "36" corresponds to the exhaust stroke; the interval between the crank angle number CRKNUM "36" and the crank angle number CRKNUM "54" corresponds to the intake stroke; the interval between the crank angle number CRKNUM "54" and the crank angle number CRKNUM "65" corresponds to the compression stroke; the interval between the crank angle number CRKNUM "65" and the crank angle number CRKNUM "18" corresponds to the power stroke.

Next, the stopping range of the engine 7 will be explained. Because of its structure and due to the effects of the pressure inside the cylinder (referred to as cylinder pressure, hereinafter) and the like, the engine 7 stops immediately after a vibration in which it alternately repeats the forward rotation and the backward rotation between the adjacent top dead centers TDCs that are produced by a plurality of cylinders.

In other words, as represented in FIG. 3, in the case where, for example, the recognition signal 1 corresponding to the interval between the crank angle number CRKNUM "8" and the crank angle number CRKNUM "10" is detected immediately before the engine 7 stops, the engine 7 stops after it vibrates between the top dead center #2TDC of the cylinder #2 and the top dead center #1TDC of the cylinder #1, or the engine 7 inertially surpasses the top dead center #1TDC of the cylinder #1 and then stops after it vibrates between the top dead center #1TDC of the cylinder #1 and the top dead center #3TDC of the cylinder #3; therefore, the engine stopping range is the interval that starts from the #2TDC, passes through the #1TDC, and reaches #3TDC, i.e., the interval between the crank angle number CRKNUM "0" and the crank angle number CRKNUM "36". The crank angle range storage means provided in the idling stop control apparatus 3 stores the crank angle numbers CRKNUMs "0" through "36", as the engine stopping range.

The piston position determination means provided in the idling stop control apparatus 3 calculates the crank angle by dividing the engine stopping range stored in the crank angle range storage means into three ranges, i.e., a first range from the starting point of the stored crank angle range to the starting point of the first recognition signal that emerges firstly, a second range from the starting point of the first recognition signal to the starting point of the second recognition signal that emerges following the first recognition signal, and a third range from the starting point of the second recognition signal to the rear end of the stored crank angle range. In other words, specifically, the piston position determination means calculates the crank angle by designating the range of the crank angle numbers CRKNUMs "0" to "8" out of the crank angle numbers CRKNUMs "0" to "36" as the "range 1", the range of the crank angle numbers CRKNUMs "8" to "25" as the "range 2", and the range of the crank angle numbers CRKNUMs "25" to "36" as the "range 3". Based on the respective ranges "range 1" through "range 3", of the crank angle numbers, that are calculated by the piston position determination means, the idling stop control apparatus 3 determines the piston position at a time when the engine stops in the following manner so as to rapidly restart the engine.

FIG. 4 is an explanatory table for explaining the operation of the internal combustion engine control system according to Embodiment 1 of the present invention; FIG. 4 represents the case where the recognition signal 1 corresponding to the interval between the crank angle number CRKNUM "8" and the crank angle number CRKNUM "10" is detected immediately before the engine stops, i.e., the case exemplified in FIG. 3, described above. In addition, FIG. 4 represents how "three ranges in the engine stopping range", "the crank angle number CRKNUM at a time when the recognition signal is found", "the cylinder to which the fuel is firstly supplied", and "the cylinder that can initially be ignited" each change as the kind of "the recognition signal found after the engine has been restarted" changes.

In other words, in FIG. 4, in the case where, after the engine is restarted, there is found "the recognition signal 1 within 8 teeth", the engine stopping range corresponds to the interval of the crank angle numbers CRKNUMs "0" through "8", which is "the range 1" represented in FIG. 3, and when the recognition signal 1 is found after the engine is restarted, the crank angle number CRKNUM is "10". In this case, as represented in FIG. 3, the cylinder to which the fuel is firstly supplied after the engine is restarted is the cylinder "#3" that is in the intake stroke during the interval corresponding to the crank angle numbers CRKNUMs "0" through "8", which is "the range 1"; the cylinders at which ignition can initially be set after the engine is restarted are the cylinder "#1" that comes into the power stroke after the recognition signal 1 is found and the cylinder "#3" to which the fuel has been supplied. In such a manner as described above, the idling stop control apparatus 3 determines the cylinder "#3" to which the fuel is firstly supplied after the engine is restarted, and firstly supplies the fuel to the cylinder "#3" immediately after the engine is restarted. The cylinders at which ignition can initially be set after the engine is restarted are the cylinder "#1" that comes into the power stroke after the recognition signal 1 is found and the cylinder "#3" to which the fuel has been supplied; therefore, the initial ignition signal is supplied to any one of these cylinders so that the engine is rapidly restarted.

In FIG. 4, in the case where, after the engine is restarted, there is found "the recognition signal 2", the engine stopping range corresponds to the interval of the crank angle numbers CRKNUMs "8" through "25", which is "the range 2" represented in FIG. 3, and when the recognition signal 2 is firstly found after the engine is restarted, the crank angle number CRKNUM is "28". In this case, if there is found "the recognition signal 2 after 9 or more teeth have passed" since the engine was restarted, it is suggested that the engine has stopped in the range of the crank angle numbers CRKNUMs "8" through "17" within "the range 2"; thus, as is clear from FIG. 3, the cylinder to which the fuel is firstly supplied after the engine is restarted is the cylinder "#3" that is in the intake stroke while the engine is in the stop mode. In such a manner as described above, the idling stop control apparatus 3 determines the cylinder "#3" to which the fuel is firstly supplied after the engine is restarted, and firstly supplies the fuel to the cylinder "#3" immediately after the engine is restarted. The cylinders at which ignition can initially be set after the engine is restarted are the cylinder "#4" that comes into the power stroke after the recognition signal 2 is found and the cylinder "#3" to which the fuel has been supplied; therefore, the initial ignition signal is supplied to any one of these cylinders so that the engine is rapidly restarted.

In contrast, if there is found "the recognition signal 2 within 8 teeth" after the engine is restarted, it is suggested that the engine has stopped in the range of the crank angle numbers CRKNUMs "18" through "25" within "the range 2"; thus, as is clear from FIG. 3, the cylinder to which the fuel is firstly supplied after the engine is restarted is the cylinder "#4" that is in the intake stroke while the engine is in the stop mode. In such a manner as described above, the idling stop control apparatus 3 determines the cylinder "#4" to which the fuel is firstly supplied after the engine is restarted, and firstly supplies the fuel to the cylinder "#4" immediately after the engine is restarted. The cylinders at which ignition can initially be set after the engine is restarted are the cylinder "#3" that comes into the power stroke after the recognition signal 2 is found and the cylinder "#4" to which the fuel has been supplied; therefore, the initial ignition signal is supplied to any one of these cylinders so that the engine is rapidly restarted.

Moreover, in FIG. 4, in the case where, after the engine is restarted, there is found "the recognition signal 1 after 9 or more teeth pass", the engine stopping range corresponds to the interval of the crank angle numbers CRKNUMs "25" through "36", which is "the range 3" represented in FIG. 3, and when the recognition signal 1 is found after the engine is restarted, the crank angle number CRKNUM is "46". In this case, as is clear from FIG. 3, the cylinder to which the fuel is firstly supplied after the engine is restarted is the cylinder "#4" that is in the intake stroke during the interval corresponding to the crank angle numbers CRKNUMs "25" through "36", which is "the range 3". In such a manner as described above, the idling stop control apparatus 3 determines the cylinder "#4" to which the fuel is firstly supplied after the engine is restarted, and firstly supplies the fuel to the cylinder "#4" immediately after the engine is restarted. The cylinders at which ignition can initially be set after the engine is restarted is the cylinder "#4" that comes into the power stroke after the recognition signal 1 is found; therefore, the initial ignition signal is supplied to the cylinder "#4" so that the engine is rapidly restarted.

Next, FIG. 5 is an explanatory table for explaining the operation of the internal combustion engine control system according to Embodiment 1 of the present invention; FIG. 5 represents how "three ranges in the engine stopping range", "the crank angle number CRKNUM at a time when the recognition signal is found", "the cylinder to which the fuel is firstly supplied", and "the cylinder that can initially be ignited" each change as the kind of "the recognition signal found after the engine has been restarted" changes, in the case where, immediately before the engine stops, the recognition signal 2 over the crank angle numbers CRKNUMs "25" through "28" is detected.

In the case where, immediately before the engine stops, the recognition signal 2 over the crank angle numbers CRKNUMs "25" through "28" is found, the engine stops after it vibrates between the top dead center #1TDC of the cylinder #1 and the top dead center #3TDC of the cylinder #3, or the engine inertially surpasses the top dead center #3TDC of the cylinder #3 and then stops after it vibrates between the top dead center #3TDC of the cylinder #3 and the top dead center #4TDC of the cylinder #4; therefore, the engine stopping range is the interval that starts from the #1TDC, passes through the #3TDC, and reaches #4TDC.

Here, assuming that "the range "1" designates the range of the crank angle numbers CRKNUMs "18" through "25", "the range "2" designates the range of the crank angle numbers CRKNUMs "25" through "44", and "the range "3" designates the range of the crank angle numbers CRKNUMs "44" through "54", the total engine stopping range is the range of the crank angle numbers CRKNUMs "18" through "54", which is the range obtained by combining the ranges "1" through "3".

In FIG. 5, if there is found "the recognition signal 2 within 7 teeth" after the engine is restarted, the engine stopping range corresponds to the range of the crank angle numbers CRKNUMs "18" through "25", which is "the range 1"; if there is found the recognition signal 2 after the engine is restarted, the crank angle number CRKNUM is "28". In this case, as represented in FIG. 3, the cylinder to which the fuel is firstly supplied after the engine is restarted is the cylinder "#4" that is in the intake stroke during the interval corresponding to the crank angle numbers CRKNUMs "18" through "25", which is "the range 1"; the cylinders at which ignition can initially be set after the engine is restarted are the cylinder "#3" that comes into the power stroke after the recognition signal 2 is found and the cylinder "#4" to which the fuel has been supplied. In such a manner as described above, the idling stop control apparatus 3 determines the cylinder "#4" to which the fuel is firstly supplied after the engine is restarted, and firstly supplies the fuel to the cylinder "#4" immediately after the engine is restarted. The initial ignition signal is supplied to any one of the cylinders "#4" and "#3" so that the engine is rapidly restarted.

In FIG. 5, if there is found "the recognition signal 1" after the engine is restarted, the engine stopping range corresponds to the range of the crank angle numbers CRKNUMs "25" through "44", which is "the range 2" represented in FIG. 3; if there is firstly found the recognition signal 1 after the engine is restarted, the crank angle number CRKNUM is "46". In this case, if there is found "the recognition signal 1 after 10 or more teeth have passed" since the engine was restarted, it is suggested that the engine has stopped in the range of the crank angle numbers CRKNUMs "25" through "35" within "the range 2"; thus, as is clear from FIG. 3, the cylinder to which the fuel is firstly supplied after the engine is restarted is the cylinder "#4" that is in the intake stroke while the engine is in the stop mode. In such a manner as described above, the idling stop control apparatus 3 determines the cylinder "#4" to which the fuel is firstly supplied after the engine is restarted, and firstly supplies the fuel to the cylinder "#4" immediately after the engine is restarted. The cylinders at which ignition can initially be set after the engine is restarted are the cylinder "#2" that comes into the power stroke after the recognition signal 1 is found and the cylinder "#4" to which the fuel has been supplied; therefore, the initial ignition signal is supplied to any one of these cylinders so that the engine is rapidly restarted.

In contrast, if there is found "the recognition signal 1 within 9 teeth" after the engine is restarted, it is suggested that the engine has stopped in the range of the crank angle numbers CRKNUMs "36" through "44" within "the range 2"; thus, as is clear from FIG. 3, the cylinder to which the fuel is firstly supplied after the engine is restarted is the cylinder "#2" that is in the intake stroke while the engine is in the stop mode. In such a manner as described above, the idling stop control apparatus 3 determines the cylinder "#2" to which the fuel is firstly supplied after the engine is restarted, and firstly supplies the fuel to the cylinder "#2" immediately after the engine is restarted. The cylinders at which ignition can initially be set after the engine is restarted are the cylinder "#4" that comes into the power stroke after the recognition signal 1 is found and the cylinder "#2" to which the fuel has been supplied; therefore, the initial ignition signal is supplied to any one of these cylinders so that the engine is rapidly restarted.

Furthermore, in FIG. 5, if there is found "the recognition signal 2 after 8 or more teeth have passed" since the engine was restarted, the engine stopping range corresponds to the range of the crank angle numbers CRKNUMs "44" through "54", which is "the range 3"; if there is firstly found the recognition signal 2 after the engine is restarted, the crank angle number CRKNUM is "64". In this case, as is clear from FIG. 3, the cylinder to which the fuel is firstly supplied after the engine is restarted is the cylinder "#2" that is in the intake stroke during the interval corresponding to the crank angle numbers CRKNUMs "44" through "54", which is "the range 3"; the cylinder at which ignition can initially be set after the engine is restarted is the cylinder "#2" that comes into the power stroke after the recognition signal 2 is found. In such a manner as described above, the idling stop control apparatus 3 determines the cylinder "#2" to which the fuel is firstly supplied after the engine is restarted, and firstly supplies the fuel to the cylinder "#2" immediately after the engine is restarted. The initial ignition signal is supplied to the cylinder "#2" after the engine is restarted so that the engine is rapidly restarted.

Next, FIG. 6 is an explanatory table for explaining the operation of the internal combustion engine control system according to Embodiment 1 of the present invention; FIG. 6 represents how "three ranges in the engine stopping range", "the crank angle number CRKNUM at a time when the recognition signal is found", "the cylinder to which the fuel is firstly supplied", and "the cylinder that can initially be ignited" each change as the kind of "the recognition signal found after the engine has been restarted" changes, in the case where, immediately before the engine stops, the recognition signal 1 over the crank angle numbers CRKNUMs "44" through "46" is detected.

In the case where, immediately before the engine stops, the recognition signal 1 over the crank angle numbers CRKNUMs "44" through "46" is found, the engine stops after it vibrates between the top dead center #3TDC of the cylinder #3 and the top dead center #4TDC of the cylinder #4, or the engine inertially surpasses the top dead center #4TDC of the cylinder #4 and then stops after it vibrates between the top dead center #4TDC of the cylinder #4 and the top dead center #2TDC of the cylinder #2; therefore, the engine stopping range is the interval that starts from the #3TDC, passes through the #4TDC, and reaches #2TDC.

Here, assuming that "the range "1" designates the range of the crank angle numbers CRKNUMs "36" through "44", "the range "2" designates the range of the crank angle numbers CRKNUMs "44" through "61", and "the range "3" designates the range of the crank angle numbers CRKNUMs "61" through "0", the total engine stopping range is the range of the crank angle numbers CRKNUMs "36" through "0", which is the range obtained by combining the ranges "1" through "3".

In FIG. 6, if there is found "the recognition signal 1 within 8 teeth" after the engine is restarted, the engine stopping range corresponds to the range of the crank angle numbers CRKNUMs "36" through "44", which is "the range 1"; if there is found the recognition signal 1 after the engine is restarted, the crank angle number CRKNUM is "46". In this case, as represented in FIG. 3, the cylinder to which the fuel is firstly supplied after the engine is restarted is the cylinder "#2" that is in the intake stroke during the interval corresponding to the crank angle numbers CRKNUMs "36" through "44", which is "the range 1"; the cylinders at which ignition can initially be set after the engine is restarted are the cylinder "#4" that comes into the power stroke after the recognition signal 1 is found and the cylinder "#2" to which the fuel has been supplied. In such a manner as described above, the idling stop control apparatus 3 determines the cylinder "#2" to which the fuel is firstly supplied after the engine is restarted, and firstly supplies the fuel to the cylinder "#2" immediately after the engine is restarted. The initial ignition signal is supplied to any one of the cylinders "#4" and "#2" so that the engine is rapidly restarted.

In FIG. 6, if there is found "the recognition signal 2" after the engine is restarted, the engine stopping range corresponds to the range of the crank angle numbers CRKNUMs "44" through "61", which is "the range 2"; if there is firstly found the recognition signal 2 after the engine is restarted, the crank angle number CRKNUM is "64". In this case, if there is found "the recognition signal 2 after 9 or more teeth have passed" since the engine was restarted, it is suggested that the engine has stopped in the range of the crank angle numbers CRKNUMs "44" through "53" within "the range 2"; thus, as is clear from FIG. 3, the cylinder to which the fuel is firstly supplied after the engine is restarted is the cylinder "#2" that is in the intake stroke while the engine is in the stop mode. In such a manner as described above, the idling stop control apparatus 3 determines the cylinder "#2" to which the fuel is firstly supplied after the engine is restarted, and firstly supplies the fuel to the cylinder "#2" immediately after the engine is restarted. The cylinders at which ignition can initially be set after the engine is restarted are the cylinder "#1" that comes into the power stroke after the recognition signal 2 is found and the cylinder "#2" to which the fuel has been supplied; therefore, the initial ignition signal is supplied to any one of these cylinders so that the engine is rapidly restarted.

In contrast, if there is found "the recognition signal 2 within 8 teeth" after the engine is restarted, it is suggested that the engine has stopped in the range of the crank angle numbers CRKNUMs "54" through "61" within "the range 2"; thus, as is clear from FIG. 3, the cylinder to which the fuel is firstly supplied after the engine is restarted is the cylinder "#1" that is in the intake stroke while the engine is in the stop mode. In such a manner as described above, the idling stop control apparatus 3 determines the cylinder "#1" to which the fuel is firstly supplied after the engine is restarted, and firstly supplies the fuel to the cylinder "#1" immediately after the engine is restarted. The cylinders at which ignition can initially be set after the engine is restarted are the cylinder "#2" that comes into the power stroke after the recognition signal 2 is found and the cylinder "#1" to which the fuel has been supplied; therefore, the initial ignition signal is supplied to any one of these cylinders so that the engine is rapidly restarted.

Furthermore, in FIG. 6, if there is found "the recognition signal 1 after 9 or more teeth have passed" since the engine was restarted, the engine stopping range corresponds to the range of the crank angle numbers CRKNUMs "61" through "0", which is "the range 3"; if there is firstly found the recognition signal 1 after the engine is restarted, the crank angle number CRKNUM is "10". In this case, as is clear from FIG. 3, the cylinder to which the fuel is firstly supplied after the engine is restarted is the cylinder "#1" that is in the intake stroke during the interval corresponding to the crank angle numbers CRKNUMs "61" through "0", which is "the range 3"; the cylinder at which ignition can initially be set after the engine is restarted is the cylinder "#1" that comes into the power stroke after the recognition signal 1 is found. In such a manner as described above, the idling stop control apparatus 3 determines the cylinder "#1" to which the fuel is firstly supplied after the engine is restarted, and firstly supplies the fuel to the cylinder "#2" immediately after the engine is restarted. The initial ignition signal is supplied to the cylinder "#1" after the engine is restarted so that the engine is rapidly restarted.

Next, FIG. 7 is an explanatory table for explaining the operation of the internal combustion engine control system according to Embodiment 1 of the present invention; FIG. 7 represents how "three ranges in the engine stopping range", "the crank angle number CRKNUM at a time when the recognition signal is found", "the cylinder to which the fuel is firstly supplied", and "the cylinder that can initially be ignited" each change as the kind of "the recognition signal found after the engine has been restarted" changes, in the case where, immediately before the engine stops, the recognition signal 2 over the crank angle numbers CRKNUMs "61" through "64" is detected.

In the case where, immediately before the engine stops, the recognition signal 2 over the crank angle numbers CRKNUMs "61" through "64" is found, the engine stops after it vibrates between the top dead center #4TDC of the cylinder #4 and the top dead center #2TDC of the cylinder #2, or the engine inertially surpasses the top dead center #2TDC of the cylinder #2 and then stops after it vibrates between the top dead center #2TDC of the cylinder #2 and the top dead center #1TDC of the cylinder #1; therefore, the engine stopping range is the interval that starts from the #4TDC, passes through the #2TDC, and reaches #1TDC.

Here, assuming that "the range "1" designates the range of the crank angle numbers CRKNUMs "54" through "61", "the range "2" designates the range of the crank angle numbers CRKNUMs "61" through "8", and "the range "3" designates the range of the crank angle numbers CRKNUMs "8" through "18", the total engine stopping range is the range of the crank angle numbers CRKNUMs "54" through "18", which is the range obtained by combining the ranges "1" through "3".

In FIG. 7, if there is found "the recognition signal 2 within 7 teeth" after the engine is restarted, the engine stopping range corresponds to the range of the crank angle numbers CRKNUMs "54" through "61", which is "the range 1"; if there is found the recognition signal 2 after the engine is restarted, the crank angle number CRKNUM is "64". In this case, as represented in FIG. 3, the cylinder to which the fuel is firstly supplied after the engine is restarted is the cylinder "#1" that is in the intake stroke during the interval corresponding to the crank angle numbers CRKNUMs "54" through "64", which is "the range 1"; the cylinders at which ignition can initially be set after the engine is restarted are the cylinder "#2" that comes into the power stroke after the recognition signal 2 is found and the cylinder "#1" to which the fuel has been supplied. In such a manner as described above, the idling stop control apparatus 3 determines the cylinder "#1" to which the fuel is firstly supplied after the engine is restarted, and firstly supplies the fuel to the cylinder "#1" immediately after the engine is restarted. The initial ignition signal is supplied to any one of the cylinders "#1" and "#2" so that the engine is rapidly restarted.

In FIG. 7, if there is found "the recognition signal 1" after the engine is restarted, the engine stopping range corresponds to the range of the crank angle numbers CRKNUMs "61" through "8", which is "the range 2"; if there is firstly found the recognition signal 1 after the engine is restarted, the crank angle number CRKNUM is "10". In this case, if there is found "the recognition signal 1 after 10 or more teeth have passed" since the engine was restarted, it is suggested that the engine has stopped in the range of the crank angle numbers CRKNUMs "61" through "71" within "the range 2"; thus, as is clear from FIG. 3, the cylinder to which the fuel is firstly supplied after the engine is restarted is the cylinder "#1" that is in the intake stroke while the engine is in the stop mode. The cylinders at which ignition can initially be set after the engine is restarted are the cylinder "#3" that comes into the power stroke after the recognition signal 1 is found and the cylinder "#1" to which the fuel has been supplied. In such a manner as described above, the idling stop control apparatus 3 determines the cylinder "#1" to which the fuel is firstly supplied after the engine is restarted, and firstly supplies the fuel to the cylinder "#1" immediately after the engine is restarted. The initial ignition signal is supplied to any one of the cylinders "#1" and "#3" so that the engine is rapidly restarted.

In contrast, if there is found "the recognition signal 1 within 9 teeth" after the engine is restarted, it is suggested that the engine has stopped in the range of the crank angle numbers CRKNUMs "0" through "8" within "the range 2"; thus, as is clear from FIG. 3, the cylinder to which the fuel is firstly supplied after the engine is restarted is the cylinder "#3" that is in the intake stroke while the engine is in the stop mode. The cylinders at which ignition can initially be set after the engine is restarted are the cylinder "#1" that comes into the power stroke after the recognition signal 1 is found and the cylinder "#3" to which the fuel has been supplied. In such a manner as described above, the idling stop control apparatus 3 determines the cylinder "#3" to which the fuel is firstly supplied after the engine is restarted, and firstly supplies the fuel to the cylinder "#3" immediately after the engine is restarted. The initial ignition signal is supplied to any one of the cylinders "#1" and "#3" so that the engine is rapidly restarted.

Furthermore, in FIG. 7, if there is found "the recognition signal 2 after 8 or more teeth have passed" since the engine was restarted, the engine stopping range corresponds to the range of the crank angle numbers CRKNUMs "8" through "18", which is "the range 3"; if there is firstly found the recognition signal 2 after the engine is restarted, the crank angle number CRKNUM is "28". In this case, as is clear from FIG. 3, the cylinder to which the fuel is firstly supplied after the engine is restarted is the cylinder "#3" that is in the intake stroke during the interval corresponding to the crank angle numbers CRKNUMs "8" through "18", which is "the range 3"; the cylinder at which ignition can initially be set after the engine is restarted is the cylinder "#3" that comes into the power stroke after the recognition signal 2 is found. In such a manner as described above, the idling stop control apparatus 3 determines the cylinder "#3" to which the fuel is firstly supplied after the engine is restarted, and firstly supplies the fuel to the cylinder "#3" immediately after the engine is restarted. The initial ignition signal is supplied to the cylinder "#3" after the engine is restarted so that the engine is rapidly restarted.

Next, the operation of the vehicle drive control system according to Embodiment 1 of the present invention will be explained with reference to the drawings. The idling stop control apparatus 3 performs electronic control of the idling stop and restarting of the engine 7. Accordingly, in order to recognize the operation statuses of the engine 7 and the reference vehicle, the idling stop control apparatus 3 receives the vehicle speed signal B, the crank angle signal D, the accelerator position signal H, and the cam angle signal C from the speed sensor 5, the crank angle sensor 6, the accelerator position sensor 11, and the cam angle sensor 15, respectively, and then calculates and outputs the injector drive signal E and the ignition plug drive signal F.

Based on the injector drive signal E from the idling stop control apparatus 3, the injector 8 injects the fuel or stops fuel injection (fuel cut-off) for a predetermined time. Based on the ignition plug drive signal F from the idling stop control apparatus 3, the ignition plug 9 is energized and ignites the fuel or stops ignition at a predetermined timing. Furthermore, based on the control signal from the idling stop control apparatus 3, the motor 14 is driven so as to rotate the engine 7 through the intermediary of the crankshaft 13.

When the internal combustion engine 7 is initially started, the idling stop control unit 31 determines the respective piston positions of the cylinders #1 through #4, by use of information items such as the crank angle signal D and the cam angle signal C from the crank angle sensor 6 and the cam angle sensor 15. When the idling stop is performed, the idling stop control unit 31 stores the crank angle of the latest recognition signal 1 or the recognition signal 2 detected through the crank angle sensor 6.

While the idling stop is performed, no special control of the engine 7 is implemented; therefore, the piston stops in the engine stopping range represented in FIGS. 3 and 4 or in the engine stopping range explained with reference to FIGS. 5 and 7. When the engine is restarted after the idling stop, the idling stop control apparatus 3 injects the fuel into the cylinder, explained with reference to FIGS. 4 through 7, that is in the intake stroke; then, by use of the crank angle signal D from the crank angle sensor 6 and the respective crank angles, of the recognition signal 1 and the recognition signal 2, stored when the idling stop is performed, the idling stop control apparatus 3 rapidly determines the respective piston positions of the cylinders, i.e., performs cylinder discrimination and then starts ignition for the cylinder that has been supplied with the fuel.

Figure 8:
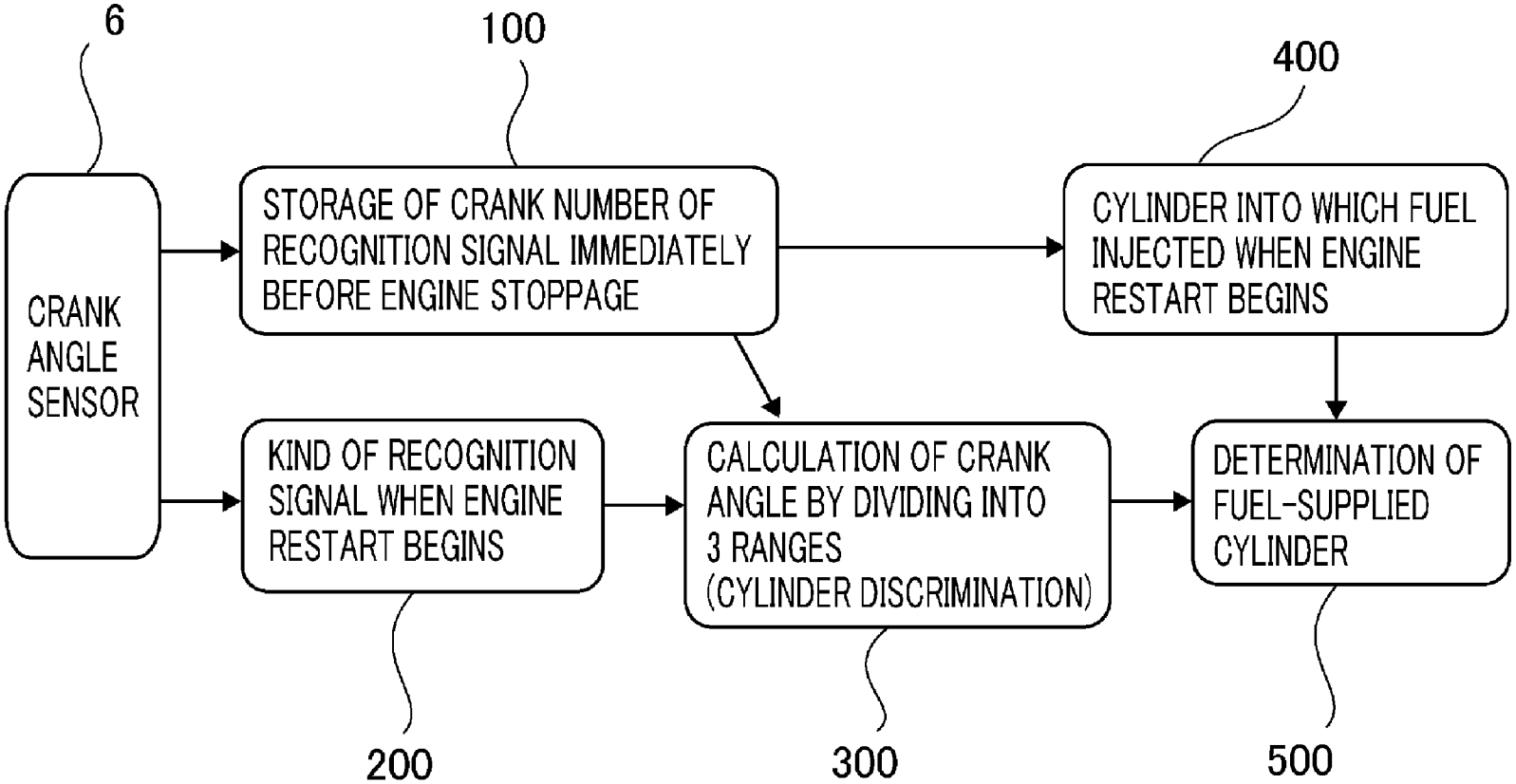
FIG. 8 is a block diagram for explaining the outline of the operation of an internal combustion engine control system according to Embodiment 1 of the present invention.

FIG. 8 is a block diagram for explaining the outline of the operation of the internal combustion engine control system according to Embodiment 1 of the present invention; there is represented the operation in which, when the engine is restarted after the idling stop, the idling stop control apparatus 3 performs processing for rapidly determining the respective piston positions of the cylinders and restarting the engine by use of the crank angle signal from the crank angle sensor 6 and the crank angle of the recognition signal stored when the idling stop is performed.

In other words, as represented in FIG. 8, in response to the crank angle signal from the crank angle sensor 6, the idling stop control apparatus 3 stores the respective crank angle numbers CRKNUMs of the recognition signal 1 and the recognition signal 2 at a time immediately before the stoppage of the engine (the step 100); furthermore, in response to the crank angle signal from the crank angle sensor 6, the idling stop control apparatus 3 discriminates between the kinds of the recognition signals at a time immediately after the restart of the engine, i.e., discriminates between the recognition signal 1 and the recognition signal 2 (the step 200). Then, the engine stopping range is divided into the three ranges, i.e., "the range 1", "the range 2", and "the range 3" so that the crank angle at a time when the engine is stopped is calculated, i.e., the cylinder discrimination is performed (the step 300), and when the restarting of the engine begins (the step 400), there is determined the cylinder (the step 500) that has been supplied with the fuel, based on the cylinder discrimination (the step 300), and then the ignition signal is given to that cylinder.

Figure 9A:
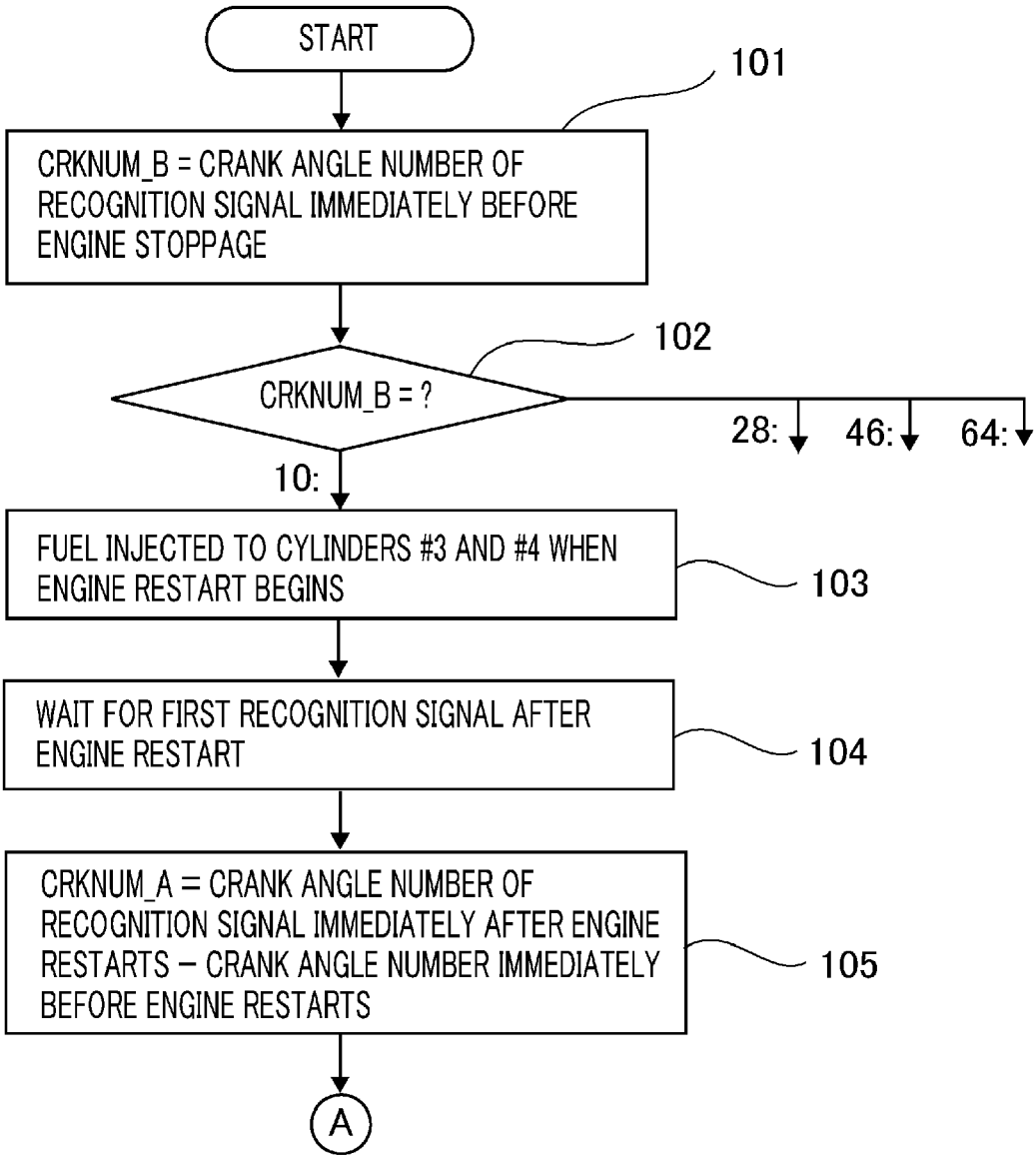
FIGS. 9A and 9B are a set of flowcharts for explaining the operation of an internal combustion engine control system according to Embodiment 1 of the present invention.
Figure 9B:
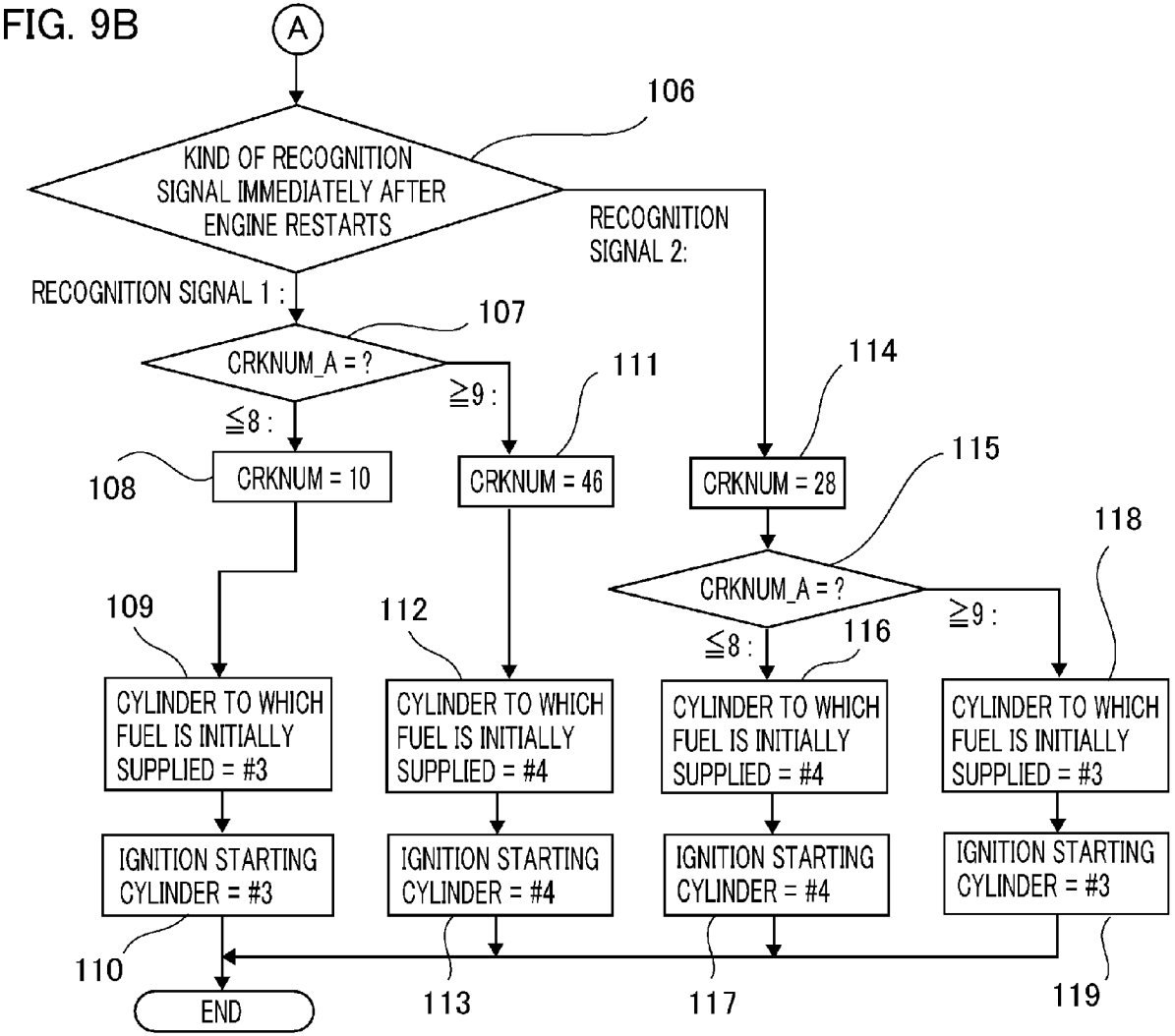

FIGS. 9A and 9B are a set of flowcharts for explaining the operation of the internal combustion engine control system according to Embodiment 1 of the present invention; there is represented the operation, of the internal combustion engine control system, in which, when the engine is restarted after the idling stop, the idling stop control apparatus 3 rapidly determines the respective piston positions of the cylinders so as to start fuel injection and ignition, by use of information from the crank angle sensor 6 and the crank angle of the recognition signal stored when the idling stop is performed. The routines represented in this flowchart are implemented, for example, after the restart of the engine.

In FIG. 9A, at first, in the step 101, there is read the crank angle number CRKNUM_B of the recognition signal at a time immediately before the stoppage of the engine. Next, in the step 102, depending on the value of the read crank angle number CRKNUM_B of the recognition signal at a time immediately before the stoppage of the engine, the following processing is selected. In other words, when the value of the read crank angle number CRKNUM_B of the recognition signal at a time immediately before the stoppage of the engine is "10", the step 102 is followed by the step 103; thereafter, processing is implemented in accordance with FIG. 4, described above. When the value of the read crank angle number CRKNUM_B of the recognition signal at a time immediately before the stoppage of the engine is "28", "46", or "64", processing is similarly implemented in accordance with FIG. 5, FIG. 6, or FIG. 7, respectively; however, explanations utilizing flowcharts will be omitted.

In the step 103, as is clear from FIG. 3, the piston position based on the engine stopping range represented in FIG. 3 suggests that the cylinder whose intake port is opened at a time when the restart of the engine begins is either the cylinder #3 or the cylinder #4; therefore, when the engine is restarted, the fuel is injected into the cylinder #3 and the cylinder #4, and then the step 103 is followed by the step 104. In the step 104, after the engine is restarted, no processing is implemented until the first recognition signal is detected, and when the first recognition signal is detected, the step 104 is followed by the step 105.

In the step 105, the crank angle numerical quantity CRKNUM_A, which is the difference between the crank angle number at a time when the first recognition signal is detected in the step 104 and the crank angle number at a time when the restart of the engine begins, is calculated from the equation [CRKNUM_A=(the crank angle number of the recognition signal at a time immediately after the restart of the engine)−(the crank angle number at a time immediately before the restart of the engine)]. The result of this calculation is utilized for performing determination in the step 107 or in the step 115, described later.

Next, in the step 106, there is determined the kind of the first recognition signal that has been detected in the step 104. In the case where the determination suggests that the recognition signal that is found after the restart of the engine begins is the recognition signal 1, the engine stopping range is "the range 1" or "the range 3", as represented in FIG. 4. In this case, the step 106 is followed by the step 107. In contrast, in the case where the determination in the step 106 suggests that the recognition signal is the recognition signal 2, the engine stopping range is "the range 2" (refer to FIG. 4). In this case, the step 106 is followed by the step 114.

In the step 107, depending on the value of the crank angle numerical quantity CRKNUM_A calculated in the foregoing step 105, the following processing is selected. In other words, when the crank angle numerical quantity CRKNUM_A is the same as or smaller than "8", the engine stopping range is "the range 1" (refer to FIG. 4); in this case, the step 107 is followed by the step 108. In contrast, when the crank angle numerical quantity CRKNUM_A is the same as or larger than "9", the engine stopping range is "the range 3" (refer to FIG. 4); in this case, the step 107 is followed by the step 111.

In the step 108, as represented in FIG. 4, as the crank angle number CRKNUM at a time when the recognition signal is found, "10" is set; then, the step 108 is followed by the step 109. In the step 109, as the number of the cylinder to which the fuel has initially been supplied, "#3" is set (refer to FIG. 4); then, the step 109 is followed by the step 110.

Next, in the step 110, the cylinders at which ignition can initially be set after the restart of the engine begins are "#1" and "#3" (refer to FIG. 4); however, because the cylinder to which the fuel has been supplied is "#3", the cylinder "#3" is selected as an ignition starting cylinder. In addition, according to circumstances, the initial ignition may be performed in the cylinder "#1". Here, the foregoing routine ends.

Meanwhile, in the case where the value of the crank angle numerical quantity CRKNUM_A calculated in the step 107 is the same as or larger than "9" and hence the step 107 is followed by the step 111, as the crank angle number CRKNUM at a time when the recognition signal is found, "46" is set (refer to FIG. 4); then, the step 111 is followed by the step 112. In the step 112, as the number of the cylinder to which the fuel has initially been supplied, "#4" is set (refer to FIG. 4); then, the step 112 is followed by the step 113. In the step 113, as the number of the cylinder to which the fuel is initially supplied after the restart of the engine begins, "#4" is set (refer to FIG. 4); then, the foregoing routine ends.

In the case where the result of the determination in the step 106 is "the recognition signal 2" and hence the step 106 is followed by the step 114, as the crank angle number CRKNUM at a time when the recognition signal is found, "28" is set in the step 114 (refer to FIG. 4). Then, the step 114 is followed by the step 115.

In the step 115, based on the value of the crank angle numerical quantity CRKNUM_A, calculated in the step 105, which is the difference between the crank angle number at a time when the first recognition signal is detected in the step 104 and the crank angle number at a time when the restart of the engine begins, the following processing is selected. That is to say, as described above with reference to FIG. 4, in the case where the crank angle numerical quantity CRKNUM_A calculated in the step 105 is the same as or smaller than "8", i.e., in the case where the recognition signal 2 is detected within 8 teeth after the restart of the engine, it is suggested that the engine has stopped in the range of the crank angle numbers CRKNUMs "18" through "25" within "the range 2", and the cylinder to which the fuel has initially been supplied after the restart of the engine is the cylinder "#4" (refer to FIG. 4); thus, the step 115 is followed by the step 116, where, as the number of the cylinder to which the fuel has initially been supplied, "#4" is set.

In contrast, in the case where the crank angle numerical quantity CRKNUM_A calculated in the step 105 is the same as or larger than "9", i.e., in the case where the recognition signal 2 is detected with 9 or more teeth after the restart of the engine, it is suggested that the engine has stopped in the range of the crank angle numbers CRKNUMs "8" through "17" within "the range 2", and the cylinder to which the fuel has initially been supplied after the restart of the engine is the cylinder "#3" (refer to FIG. 4); thus, the step 115 is followed by the step 118, where, as the number of the cylinder to which the fuel has initially been supplied, "#3" is set.

The step 116 is followed by the step 117, where, as the ignition starting cylinder, "#4" is set, because, as described above with reference to FIG. 4, the cylinders at which initial ignition can be set after the restart of the engine are "#3" and "#4" and the cylinder to which the fuel has been supplied is "#4". In addition, according to circumstances, the initial ignition may be performed in the cylinder "#3". Here, the foregoing routine ends.

The step 118 is followed by the step 119, where, as the ignition starting cylinder, "#3" is set, because, as described above with reference to FIG. 4, the cylinders at which initial ignition can be set after the restart of the engine are "#3" and "#4" and the cylinder to which the fuel has been supplied is "#3". Here, the foregoing routine ends.

As described above, in the internal combustion engine control system according to Embodiment 1 of the present invention, the crank angle sensor is configured in such a way as to have recognition signals, the number of which is the maximum prime number, among the prime numbers included in the number of the engine cylinders, which is a divisor of the number of the cylinders, i.e., in such a way as to have 2 kinds of recognition signals; therefore, the crank angle sensor can be inexpensive. Moreover, control and calculation are simplified and the piston position at a time when the engine is restarted can be determined readily and inexpensively; therefore, ignition can securely be performed at the cylinder to which the fuel is initially supplied, whereby the engine can rapidly be restarted.

Embodiment 2

Figure 10:
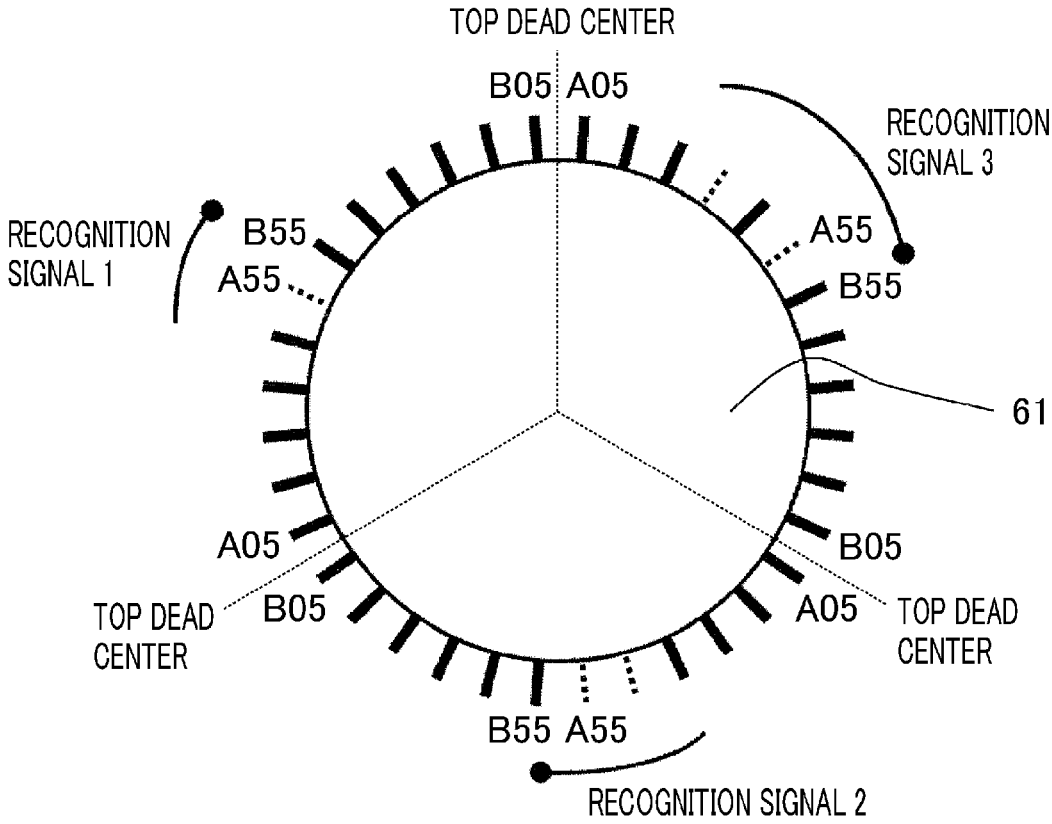
FIG. 10 is an explanatory chart representing the configuration of the signal rotor of a crank angle sensor in an internal combustion engine control system according to Embodiment 2 of the present invention.

Next, there will be explained an internal combustion engine control system according to Embodiment 2 of the present invention. The internal combustion engine control system according to Embodiment 2 is applied to a 6-cylinder and 4-stroke engine. FIG. 10 is an explanatory chart representing the configuration of the signal rotor of the crank angle sensor in the internal combustion engine control system according to Embodiment 2 of the present invention. The configuration illustrated in FIG. 1 is applied also to Embodiment 2.

In FIG. 10, a signal rotor 61 is configured in such a way as to generate a recognition signal 1, a recognition signal 2, and a recognition signal 3; the number of the recognition signals corresponds to the divisor "3", among the divisors "1", "2", and "3" of the number "6" of engine cylinders, which is the maximum prime number.

The configuration of the signal rotor 61 will be described further in detail; on the outer circumference thereof, the signal rotor 61 is provided with teeth (illustrated with solid lines)

formed of 31 magnetic materials. These 31 teeth are provided at 31 positions among 36 positions obtained by equally dividing the outer circumference of the signal rotor 61 in steps of 10° with respect to the center axis of the signal rotor 61. Among the 36 positions on the outer circumference of the signal rotor 61, the rest 5 are the positions for missing teeth (illustrated with broken lines) where no tooth exists.

In the case of 6-cylinder and 4-stroke engine, the respective pistons of the 6 cylinders are each configured in such a way as to sequentially reach the top dead center at the crank angle 120° CA, 240° CA, 360° CA, 480° CA, 600° CA, and 720° CA. Accordingly, on the outer circumference of the signal rotor 61, positions corresponding to the piston top dead centers are set in such a way as to be spaced apart from each other by 120°; teeth B05 and A05 are disposed in such a way as to flank each of the three positions corresponding to the top dead centers. These three positions, on the signal rotor 61, corresponding to the top dead centers correspond to the respective piston top dead centers of two cylinders; the details thereof will be described later with reference to FIG. 11.

It is assumed that A05 designates the tooth situated at the left side of the position corresponding to the bottom-left top dead center in FIG. 10, and A55 designates the missing tooth situated at the position that is the 6th position from the bottom-left top dead center when being counted clockwise including the tooth A05. In addition, it is assumed that B55 designates the tooth situated at the next position of the missing tooth A55, and B05 designates the tooth situated at the position that is the 6th position from the missing tooth A55 when being counted clockwise including the tooth B55. Furthermore, the tooth following the tooth B05 is designated by A05, and the teeth situated at the positions that are the 4th and 6th positions from the tooth B05 when being counted clockwise including the tooth A05 are missing teeth; the missing tooth situated at that 6th position is designated by A55. In addition, it is assumed that B55 designates the tooth situated at the next position of the missing tooth A55, and B05 designates the tooth situated at the position that is the 6th position from the missing tooth A55 when being counted clockwise including the tooth B55. Furthermore, the tooth following the tooth B05 is designated by A05, and the teeth situated at the positions that are the 5th and 6th positions from the tooth B05 when being counted clockwise including the tooth A05 are missing teeth; the missing tooth situated at that 6th position is designated by A55. In addition, it is assumed that B55 designates the tooth situated at the next position of the missing tooth A55, and B05 designates the tooth situated at the position that is the 6th position from the missing tooth A55 when being counted clockwise including the tooth B55.

Here, the recognition signal 1 is formed of three teeth, i.e., the top-left missing tooth A55 in FIG. 10 and the two teeth (one of them is the tooth B55) that flank the missing tooth A55. The recognition signal 3 is formed of five teeth (two of them, including A55, are missing teeth), i.e., the top-right missing tooth A55 in FIG. 10, the tooth that is 3 positions before the missing tooth A55, the missing tooth immediately after that tooth, the tooth immediately after that missing tooth, and the tooth B55 immediately after the missing tooth A55. Furthermore, the recognition signal 2 is formed of four teeth (two of them are missing teeth), i.e., the bottom missing tooth A55 in FIG. 10, the tooth that is 2 positions before the missing tooth A55, the missing tooth immediately after that tooth, and the tooth B55 immediately after the missing tooth A55.

As represented in FIG. 10, the recognition signal 1, the recognition signal 2, and the recognition signal 3 are set at the positions that are spaced 120° apart from one another with respect to the center axis of the signal rotor 61. As described later, the recognition signal 1, the recognition signal 2, and the recognition signal 3 are set in order to determine the respective piston positions of six cylinders, based on the crank angle signal D.

In Embodiment 2, by providing positions for missing teeth, the recognition signal 1, the recognition signal 2, and the recognition signal 3 are formed; however, any other method may be adopted as long as setting is made in such a way that the recognition signal 1, the recognition signal 2, and the recognition signal 3 can be outputted.

Figure 11:
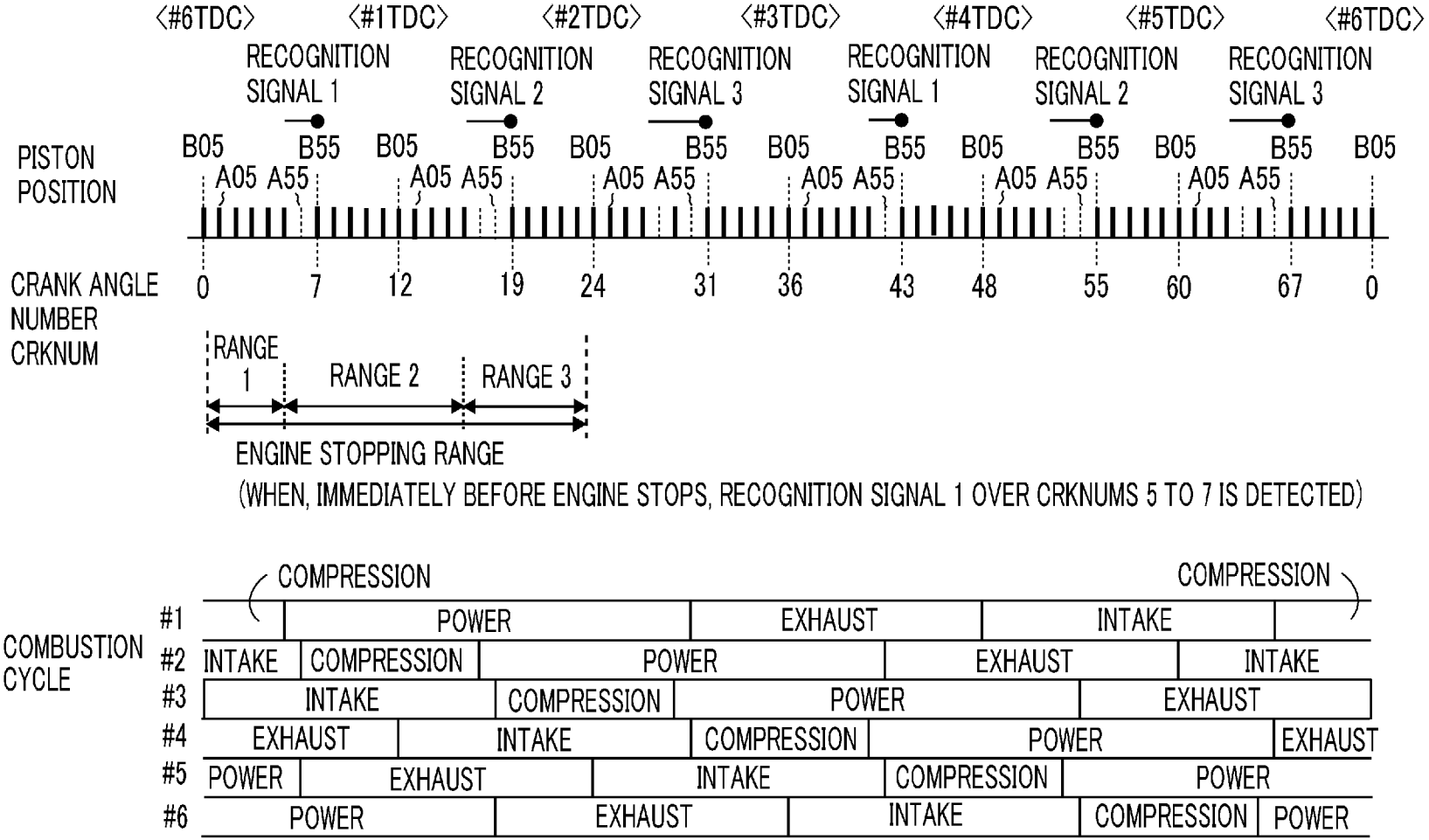
FIG. 11 is an explanatory chart representing the waveform of the output of a crank angle sensor in an internal combustion engine control system according to Embodiment 2 of the present invention, as well as the relationship between the engine stopping range and the combustion cycle.

FIG. 11 is an explanatory chart representing the waveform of the output of a crank angle sensor in the internal combustion engine control system according to Embodiment 2 of the present invention, as well as the relationship between the engine stopping range and the combustion cycle. In FIG. 11, the waveform of the crank angle signal is the waveform of a signal that is outputted from the magnetic detection unit 62 when the signal rotor 61 of the crank angle sensor represented in FIG. 10 rotates counterclockwise in synchronization with the rotation of the crankshaft 13; by use of the same reference characters as those of the teeth or the missing teeth of the signal rotor 61, there are represented the waveforms of the crank angle signals that are produced in accordance with the positions on the signal rotor 61 in FIG. 10, i.e., in accordance with the bottom-left tooth B05, as the starting position, the tooth A05, - - - , A55, B55, - - - , B05, A05, - - - , A55, B55, - - - , B05, A05, - - - , and A55 in that order.

In Embodiment 2, the engine 7 is provided with six cylinders, i.e., a cylinder 1, a cylinder 2, a cylinder 3, a cylinder 4, a cylinder 5, and a cylinder 6; reference characters #1, #2, #3, #4, #5, and #6 denote the cylinder 1, the cylinder 2, the cylinder 3, the cylinder 4, the cylinder 5, and the cylinder 6, respectively. In each of the cylinders #1 through #6, the crank angle 720° CA, i.e., two rotations of the crankshaft 13 correspond to a single cycle consisting of an "intake" stroke, a "compression" stroke, a "combustion" stroke, and an "exhaust" stroke.

In FIG. 11, the crank angle number CRKNUM (equivalent to the crank angle CA, and referred to as a crank angle number CRKNUM, hereinafter) corresponding to the crank angle signal B05 at the starting position is "0"; the crank angle number CRKNUM corresponding to the next crank angle signal A05 is "1"; the crank angle numbers CRKNUMs corresponding to the crank angle signals, which are sequentially produced thereafter, are "2", "3", - - - , "71"; at last, returning to the crank angle signal B05 at the starting position, the crank angle number CRKNUM is "0".

Accordingly, as represented in FIG. 11, the recognition signal 1 is generated in accordance with the crank angle numbers CRKNUMs "5", "6", and "7", while the crankshaft 13 rotates twice; next, the recognition signal 2 is generated in accordance with the crank angle numbers CRKNUMs "16", "17", "18", and "19"; next, the recognition signal 3 is generated in accordance with the crank angle numbers CRKNUMs "27", "28", "29", "30", and "31". Furthermore, the recognition signal 1 is generated in accordance with the crank angle numbers CRKNUMs "41", "42", and "43"; next, the recognition signal 2 is generated in accordance with the crank angle numbers CRKNUMs "52", "53", and "55"; next, the recognition signal 3 is generated in accordance with the crank angle numbers CRKNUMs "63", "64", "65", "66", and "67".

The piston of the cylinder #6 reaches the top dead center #6TDC when the crank angle number CRKNUM is "0"; the piston of the cylinder #1 reaches the top dead center #1TDC when the crank angle number CRKNUM is "12"; the piston of the cylinder #2 reaches the top dead center #2TDC when the crank angle number CRKNUM is "24"; the piston of the cylinder #3 reaches the top dead center #3TDC when the crank angle number CRKNUM is "36". The piston of the cylinder #4 reaches the top dead center #4TDC when the crank angle number CRKNUM is "48"; the piston of the cylinder #5 reaches the top dead center #5TDC when the crank angle number CRKNUM is "60".

As represented in FIG. 11, in the cylinder #1, the interval between the crank angle number CRKNUM "5" and the crank angle number CRKNUM "30" corresponds to the power stroke; the interval between the crank angle number CRKNUM "30" and the crank angle number CRKNUM "48" corresponds to the exhaust stroke; the interval between the crank angle number CRKNUM "48" and the crank angle number CRKNUM "66" corresponds to the intake stroke; the interval between the crank angle number CRKNUM "66" and the crank angle number CRKNUM "5" corresponds to the compression stroke.

In the cylinder #2, the interval between the crank angle number CRKNUM "6" and the crank angle number CRKNUM "17" corresponds to the compression stroke; the interval between the crank angle number CRKNUM "17" and the crank angle number CRKNUM "42" corresponds to the power stroke; the interval between the crank angle number CRKNUM "42" and the crank angle number CRKNUM "60" corresponds to the exhaust stroke; the interval between the crank angle number CRKNUM "60" and the crank angle number CRKNUM "6" corresponds to the intake stroke.

In the cylinder #3, the interval between the crank angle number CRKNUM "0" and the crank angle number CRKNUM "18" corresponds to the intake stroke; the interval between the crank angle number CRKNUM "18" and the crank angle number CRKNUM "29" corresponds to the compression stroke; the interval between the crank angle number CRKNUM "29" and the crank angle number CRKNUM "54" corresponds to the power stroke; the interval between the crank angle number CRKNUM "54" and the crank angle number CRKNUM "0" corresponds to the exhaust stroke.

In the cylinder #4, the interval between the crank angle number CRKNUM "12" and the crank angle number CRKNUM "30" corresponds to the intake stroke; the interval between the crank angle number CRKNUM "30" and the crank angle number CRKNUM "41" corresponds to the compression stroke; the interval between the crank angle number CRKNUM "41" and the crank angle number CRKNUM "66" corresponds to the power stroke; the interval between the crank angle number CRKNUM "66" and the crank angle number CRKNUM "12" corresponds to the exhaust stroke.

In the cylinder #5, the interval between the crank angle number CRKNUM "6" and the crank angle number CRKNUM "24" corresponds to the exhaust stroke; the interval between the crank angle number CRKNUM "24" and the crank angle number CRKNUM "42" corresponds to the intake stroke; the interval between the crank angle number CRKNUM "42" and the crank angle number CRKNUM "53" corresponds to the compression stroke; the interval between the crank angle number CRKNUM "53" and the crank angle number CRKNUM "6" corresponds to the power stroke.

In the cylinder #6, the interval between the crank angle number CRKNUM "18" and the crank angle number CRKNUM "36" corresponds to the exhaust stroke; the interval between the crank angle number CRKNUM "36" and the crank angle number CRKNUM "54" corresponds to the intake stroke; the interval between the crank angle number CRKNUM "54" and the crank angle number CRKNUM "65" corresponds to the compression stroke; the interval between the crank angle number CRKNUM "65" and the crank angle number CRKNUM "18" corresponds to the power stroke.

Next, the stopping range of the engine 7 will be explained. As described above, because of its structure and due to the effects of the cylinder pressure and the like, the engine 7 stops immediately after a vibration in which it alternately repeats the forward rotation and the backward rotation between the adjacent top dead centers TDCs that are produced by a plurality of cylinders.

In other words, as represented in FIG. 11, in the case where, for example, the recognition signal 1 corresponding to the interval between the crank angle number CRKNUM "5" and the crank angle number CRKNUM "7" is detected immediately before the engine 7 stops, the engine 7 stops after it vibrates between the top dead center #6TDC of the cylinder #6 and the top dead center #1TDC of the cylinder #1, or the engine 7 inertially surpasses the top dead center #1TDC of the cylinder #1 and then stops after it vibrates between the top dead center #1TDC of the cylinder #1 and the top dead center #2TDC of the cylinder #2; therefore, the engine stopping range is the interval that starts from the #6TDC, passes through the #1TDC, and reaches #2TDC. The crank angle range storage means provided in the idling stop control apparatus 3 stores the crank angle numbers CRKNUMs "0" through "24", as the engine stopping range.

The piston position determination means provided in the idling stop control apparatus 3 calculates the crank angle by dividing the engine stopping range stored in the crank angle range storage means into three ranges, i.e., a first range from the starting point of the stored crank angle range to the starting point of the first recognition signal that emerges firstly, a second range from the starting point of the first recognition signal to the starting point of the second recognition signal that emerges following the first recognition signal, and a third range from the starting point of the second recognition signal to the rear end of the stored crank angle range. In other words, specifically, the piston position determination means calculates the crank angle by designating the range of the crank angle numbers CRKNUMs "0" to "5" out of the crank angle numbers CRKNUMs "0" to "24" as the "range 1", the range of the crank angle numbers CRKNUMs "5" to "16" as the "range 2", and the range of the crank angle numbers CRKNUMs "16" to "24" as the "range 3". Based on the respective ranges "range 1" through "range 3", of the crank angle numbers, that are calculated by the piston position determination means, the idling stop control apparatus 3 determines the piston position at a time when the engine stops in the following manner so as to rapidly restart the engine.

FIG. 12 is an explanatory table for explaining the operation of the internal combustion engine control system according to Embodiment 2 of the present invention; FIG. 12 represents the case where the recognition signal 1 corresponding to the interval between the crank angle number CRKNUM "5" and the crank angle number CRKNUM "7" is detected immediately before the engine stops, i.e., the case exemplified in FIG. 11, described above. In addition, FIG. 12 represents how "three ranges in the engine stopping range", "the crank angle number CRKNUM at a time when the recognition signal is found", "the cylinder to which a fuel is firstly supplied", and "the cylinder that can initially be ignited" each change as the kind of "the recognition signal found after the engine has been restarted" changes.

In other words, in FIG. 12, if there is found "the recognition signal 1" after the engine is restarted, the engine stopping range corresponds to the range of the crank angle numbers CRKNUMs "0" through "5", which is "the range 1" represented in FIG. 11; if there is found the recognition signal 1 after the engine is restarted, the crank angle number CRKNUM is "7". In this case, as represented in FIG. 3, the cylinders to which the fuel is firstly supplied after the engine is restarted are the cylinders "#2" and "#3" that are in the intake stroke during the interval corresponding to the crank angle numbers CRKNUMs "0" through "5", which is "the range 1"; the cylinders at which ignition can initially be set after the engine is restarted are the cylinder "#1" that comes into the power stroke after the recognition signal 1 is found and the cylinders "#2" and "#3" to which the fuel has been supplied. In such a manner as described above, the idling stop control apparatus 3 determines the cylinders "#2" and "#3" to which the fuel is firstly supplied after the engine is restarted, and firstly supplies the fuel to the cylinders "#2" and "#3" immediately after the engine is restarted. The initial ignition signal is supplied to any one of the cylinders "#1" through "#3" so that the engine is rapidly restarted.

In FIG. 12, if there is found "the recognition signal 2" after the engine is restarted, the engine stopping range corresponds to the range of the crank angle numbers CRKNUMs "5" through "16", which is "the range 2" represented in FIG. 11; if there is firstly found the recognition signal 2 after the engine is restarted, the crank angle number CRKNUM is "19". In this case, if there is found "the recognition signal 2 after 6 or more teeth have passed" since the engine was restarted, it is suggested that the engine has stopped in the range of the crank angle numbers CRKNUMs "5" through "11" within "the range 2"; thus, as is clear from FIG. 11, the cylinder to which the fuel is firstly supplied after the engine is restarted is the cylinder "#3" that is in the intake stroke while the engine is in the stop mode. The cylinders at which ignition can initially be set after the engine is restarted are the cylinder "#2" and "#4" that come into the power stroke after the recognition signal 2 is found and the cylinder "#3" to which the fuel has been supplied. In such a manner as described above, the idling stop control apparatus 3 determines the cylinder "#3" to which the fuel is firstly supplied after the engine is restarted, and firstly supplies the fuel to the cylinder "#3" immediately after the engine is restarted. The initial ignition signal is supplied to any one of the cylinders "#2" through "#4" so that the engine is rapidly restarted.

In contrast, if there is found "the recognition signal 2 within 5 teeth" after the engine is restarted, it is suggested that the engine has stopped in the range of the crank angle numbers CRKNUMs "12" through "16" within "the range 2"; thus, as is clear from FIG. 11, the cylinders to which the fuel is firstly supplied after the engine is restarted are the cylinder "#3" and "#4" that are in the intake stroke while the engine is in the stop mode. The cylinders at which ignition can initially be set after the engine is restarted are the cylinder "#2" that comes into the power stroke after the recognition signal 2 is found and the cylinder "#3" and "#4" to which the fuel has been supplied. In such a manner as described above, the idling stop control apparatus 3 determines the cylinders "#3" and "#4" to which the fuel is firstly supplied after the engine is restarted, and firstly supplies the fuel to the cylinders "#3" and "#4" immediately after the engine is restarted. The initial ignition signal is supplied to any one of the cylinders "#2" through "#4" so that the engine is rapidly restarted.

Furthermore, in FIG. 12, if there is found "the recognition signal 3" after the engine is restarted, the engine stopping range corresponds to the range of the crank angle numbers CRKNUMs "16" through "24", which is "the range 3" represented in FIG. 3; if there is firstly found the recognition signal 3 after the engine is restarted, the crank angle number CRKNUM is "31". In this case, as is clear from FIG. 11, the cylinder to which the fuel is firstly supplied after the engine is restarted is the cylinder "#4" that is in the intake stroke during the interval corresponding to the crank angle numbers CRKNUMs "16" through "24", which is "the range 3"; the cylinders at which ignition can initially be set after the engine is restarted are the cylinder "#3" that comes into the power stroke after the recognition signal 3 is found and the cylinder "#4" to which the fuel has been supplied. In such a manner as described above, the idling stop control apparatus 3 determines the cylinder "#4" to which the fuel is firstly supplied after the engine is restarted, and firstly supplies the fuel to the cylinders "#3" or "#4" immediately after the engine is restarted so as to rapidly restart the engine.

Next, FIG. 13 is an explanatory table for explaining the operation of the internal combustion engine control system according to Embodiment 2 of the present invention; FIG. 13 represents how "three ranges in the engine stopping range", "the crank angle number CRKNUM at a time when the recognition signal is found", "the cylinder to which the fuel is firstly supplied", and "the cylinder that can initially be ignited" each change as the kind of "the recognition signal found after the engine has been restarted" changes, in the case where, immediately before the engine stops, the recognition signal 2 over the crank angle numbers CRKNUMs "16" through "19" is detected.

In the case where, immediately before the engine stops, the recognition signal 2 over the crank angle numbers CRKNUMs "16" through "19" is found, the engine stops after it vibrates between the top dead center #1TDC of the cylinder #1 and the top dead center #2TDC of the cylinder #2, or the engine inertially surpasses the top dead center #2TDC of the cylinder #2 and then stops after it vibrates between the top dead center #2TDC of the cylinder #2 and the top dead center #3TDC of the cylinder #3; therefore, the engine stopping range is the interval that starts from the #1TDC, passes through the #2TDC, and reaches #3TDC.

Here, assuming that "the range "1" designates the range of the crank angle numbers CRKNUMs "12" through "16", "the range "2" designates the range of the crank angle numbers CRKNUMs "16" through "27", and "the range "3" designates the range of the crank angle numbers CRKNUMs "27" through "36", the total engine stopping range is the range of the crank angle numbers CRKNUMs "12" through "36", which is the range obtained by combining the ranges "1" through "3". The crank angle range storage means provided in the idling stop control apparatus 3 stores the crank angle numbers CRKNUMs "12" through "36", as the engine stopping range.

In FIG. 13, if there is found "the recognition signal 2" after the engine is restarted, the engine stopping range corresponds to the range of the crank angle numbers CRKNUMs "12" through "16", which is "the range 1"; if there is found the recognition signal 2 after the engine is restarted, the crank angle number CRKNUM is "19". In this case, as represented in FIG. 13, the cylinders to which the fuel is firstly supplied after the engine is restarted are the cylinders "#3" and "#4" that are in the intake stroke during the interval corresponding to the crank angle numbers CRKNUMs "12" through "16", which is "the range 1"; the cylinders at which ignition can initially be set after the engine is restarted are the cylinder "#2" that comes into the power stroke after the recognition signal 2 is found and the cylinders "#3" and "#4" to which the fuel has been supplied. In such a manner as described above, the idling stop control apparatus 3 determines the cylinders "#3" and "#4" to which the fuel is firstly supplied after the engine is restarted, and firstly supplies the fuel to the cylinders "#3" and "#4" immediately after the engine is restarted.

The initial ignition signal is supplied to any one of the cylinders "#2" through "#4" so that the engine is rapidly restarted.

In FIG. 13, if there is found "the recognition signal 3" after the engine is restarted, the engine stopping range corresponds to the range of the crank angle numbers CRKNUMs "16" through "27", which is "the range 2"; if there is firstly found the recognition signal 3 after the engine is restarted, the crank angle number CRKNUM is "31". In this case, if there is found "the recognition signal 3 after 5 or more teeth have passed" since the engine was restarted, it is suggested that the engine has stopped in the range of the crank angle numbers CRKNUMs "16" through "23" within "the range 2"; thus, as is clear from FIG. 11, the cylinder to which the fuel is firstly supplied after the engine is restarted is the cylinder "#4" that is in the intake stroke while the engine is in the stop mode. The cylinders at which ignition can initially be set after the engine is restarted are the cylinder "#3" and "#5" that come into the power stroke after the recognition signal 3 is found and the cylinder "#4" to which the fuel has been supplied. In such a manner as described above, the idling stop control apparatus 3 determines the cylinder "#4" to which the fuel is firstly supplied after the engine is restarted, and firstly supplies the fuel to the cylinder "#4" immediately after the engine is restarted; the initial ignition signal is supplied to any one of the cylinders "#3" through "#5" so that the engine is rapidly restarted.

In contrast, if there is found "the recognition signal 3 within 4 teeth" after the engine is restarted, it is suggested that the engine has stopped in the range of the crank angle numbers CRKNUMs "24" through "27" within "the range 2"; thus, as is clear from FIG. 11, the cylinders to which the fuel is firstly supplied after the engine is restarted are the cylinder "#4" and "#5" that are in the intake stroke while the engine is in the stop mode. The cylinders at which ignition can initially be set after the engine is restarted are the cylinder "#3" that comes into the power stroke after the recognition signal 3 is found and the cylinder "#4" and "#5" to which the fuel has been supplied. In such a manner as described above, the idling stop control apparatus 3 determines the cylinders "#4" and "#5" to which the fuel is firstly supplied after the engine is restarted, and firstly supplies the fuel to the cylinders "#4" and "#5" immediately after the engine is restarted; the initial ignition signal is supplied to any one of the cylinders "#3" through "#5" so that the engine is rapidly restarted.

In FIG. 13, if there is found "the recognition signal 1" after the engine is restarted, the engine stopping range corresponds to the range of the crank angle numbers CRKNUMs "27" through "36", which is "the range 3"; if there is firstly found the recognition signal 1 after the engine is restarted, the crank angle number CRKNUM is "43". In this case, as is clear from FIG. 11, the cylinder to which the fuel is firstly supplied after the engine is restarted is the cylinder "#5" that is in the intake stroke during the interval corresponding to the crank angle numbers CRKNUMs "27" through "36", which is "the range 3"; the cylinders at which ignition can initially be set after the engine is restarted are the cylinder "#4" that comes into the power stroke after the recognition signal 1 is found and the cylinder "#5" to which the fuel has been supplied. In such a manner as described above, the idling stop control apparatus 3 determines the cylinder "#5" to which the fuel is firstly supplied after the engine is restarted, and firstly supplies the fuel to the cylinder "#5" immediately after the engine is restarted; the initial ignition signal is supplied to the cylinder "#4" or the cylinder "#5" so that the engine is rapidly restarted.

Next, FIG. 14 is an explanatory table for explaining the operation of the internal combustion engine control system according to Embodiment 2 of the present invention; FIG. 14 represents how "three ranges in the engine stopping range", "the crank angle number CRKNUM at a time when the recognition signal is found", "the cylinder to which the fuel is firstly supplied", and "the cylinder that can initially be ignited" each change as the kind of "the recognition signal found after the engine has been restarted" changes, in the case where, immediately before the engine stops, the recognition signal 3 over the crank angle numbers CRKNUMs "27" through "31" is detected.

In the case where, immediately before the engine stops, the recognition signal 3 over the crank angle numbers CRKNUMs "27" through "31" is found, the engine stops after it vibrates between the top dead center #2TDC of the cylinder #2 and the top dead center #3TDC of the cylinder #3, or the engine inertially surpasses the top dead center #3TDC of the cylinder #3 and then stops after it vibrates between the top dead center #3TDC of the cylinder #3 and the top dead center #4TDC of the cylinder #4; therefore, the engine stopping range is the interval that starts from the #2TDC, passes through the #3TDC, and reaches #4TDC.

Here, assuming that "the range "1" designates the range of the crank angle numbers CRKNUMs "24" through "27", "the range "2" designates the range of the crank angle numbers CRKNUMs "27" through "41", and "the range "3" designates the range of the crank angle numbers CRKNUMs "41" through "48", the total engine stopping range is the range of the crank angle numbers CRKNUMs "24" through "48", which is the range obtained by combining the ranges "1" through "3". The crank angle range storage means provided in the idling stop control apparatus 3 stores the crank angle numbers CRKNUMs "24" through "48", as the engine stopping range.

In FIG. 14, if there is found "the recognition signal 3" after the engine is restarted, the engine stopping range corresponds to the range of the crank angle numbers CRKNUMs "24" through "27", which is "the range 1"; if there is found the recognition signal 3 after the engine is restarted, the crank angle number CRKNUM is "31". In this case, as represented in FIG. 11, the cylinders to which the fuel is firstly supplied after the engine is restarted are the cylinders "#4" and "#5" that are in the intake stroke during the interval corresponding to the crank angle numbers CRKNUMs "24" through "27", which is "the range 1"; the cylinders at which ignition can initially be set after the engine is restarted are the cylinder "#3" that comes into the power stroke after the recognition signal 3 is found and the cylinders "#4" and "#5" to which the fuel has been supplied. In such a manner as described above, the idling stop control apparatus 3 determines the cylinders "#4" and "#5" to which the fuel is firstly supplied after the engine is restarted, and firstly supplies the fuel to the cylinders "#4" and "#5" immediately after the engine is restarted; the initial ignition signal is supplied to any one of the cylinders "#3" through "#5" so that the engine is rapidly restarted.

In FIG. 14, if there is found "the recognition signal 1" after the engine is restarted, the engine stopping range corresponds to the range of the crank angle numbers CRKNUMs "27" through "41", which is "the range 2"; if there is firstly found the recognition signal 1 after the engine is restarted, the crank angle number CRKNUM is "43". In this case, if there is found "the recognition signal 1 after 7 or more teeth have passed" since the engine was restarted, it is suggested that the engine has stopped in the range of the crank angle numbers CRKNUMs "27" through "35" within "the range 2"; thus, as is clear from FIG. 11, the cylinder to which the fuel is firstly supplied after the engine is restarted is the cylinder "#5" that is in the intake stroke while the engine is in the stop mode; the cylinders at which ignition can initially be set after the engine is restarted are the cylinders "#4" and "#6" that come into the power stroke after the recognition signal 1 is found and the cylinder "#5" to which the fuel has been supplied. In such a manner as described above, the idling stop control apparatus 3 determines the cylinder "#5" to which the fuel is firstly supplied after the engine is restarted, and firstly supplies the fuel to the cylinder "#5" immediately after the engine is restarted; the initial ignition signal is supplied to any one of the cylinders "#4" through "#6" so that the engine is rapidly restarted.

In contrast, if there is found "the recognition signal 1 within 6 teeth" after the engine is restarted, it is suggested that the engine has stopped in the range of the crank angle numbers CRKNUMs "36" through "41" within "the range 2"; thus, as is clear from FIG. 11, the cylinders to which the fuel is firstly supplied after the engine is restarted are the cylinder "#5" and "#6" that are in the intake stroke while the engine is in the stop mode. The cylinders at which ignition can initially be set after the engine is restarted are the cylinder "#4" that comes into the power stroke after the recognition signal 1 is found and the cylinder "#5" and "#6" to which the fuel has been supplied. In such a manner as described above, the idling stop control apparatus 3 determines the cylinders "#5" and "#6" to which the fuel is firstly supplied after the engine is restarted, and firstly supplies the fuel to the cylinders "#5" and "#6" immediately after the engine is restarted; the initial ignition signal is supplied to any one of the cylinders "#4" through "#6" so that the engine is rapidly restarted.

Furthermore, in FIG. 14, if there is found "the recognition signal 2" after the engine is restarted, the engine stopping range corresponds to the range of the crank angle numbers CRKNUMs "41" through "48", which is "the range 3"; if there is firstly found the recognition signal 2 after the engine is restarted, the crank angle number CRKNUM is "55". In this case, as is clear from FIG. 11, the cylinder to which the fuel is firstly supplied after the engine is restarted is the cylinder "#6" that is in the intake stroke during the interval corresponding to the crank angle numbers CRKNUMs "41" through "48", which is "the range 3"; the cylinders at which ignition can initially be set after the engine is restarted are the cylinder "#5" that comes into the power stroke after the recognition signal 2 is found and the cylinder "#6" to which the fuel has been supplied. In such a manner as described above, the idling stop control apparatus 3 determines the cylinder "#6" to which the fuel is firstly supplied after the engine is restarted, and firstly supplies the fuel to the cylinder "#6" immediately after the engine is restarted; the initial ignition signal is supplied to the cylinder "#5" or the cylinder "#6" so that the engine is rapidly restarted.

Next, FIG. 15 is an explanatory table for explaining the operation of the internal combustion engine control system according to Embodiment 2 of the present invention; FIG. 15 represents how "three ranges in the engine stopping range", "the crank angle number CRKNUM at a time when the recognition signal is found", "the cylinder to which the fuel is firstly supplied", and "the cylinder that can initially be ignited" each change as the kind of "the recognition signal found after the engine has been restarted" changes, in the case where, immediately before the engine stops, the recognition signal 1 over the crank angle numbers CRKNUMs "41" through "43" is found.

In the case where, immediately before the engine stops, the recognition signal 1 over the crank angle numbers CRKNUMs "41" through "43" is found, the engine stops after it vibrates between the top dead center #3TDC of the cylinder #3 and the top dead center #4TDC of the cylinder #4, or the engine inertially surpasses the top dead center #4TDC of the cylinder #4 and then stops after it vibrates between the top dead center #4TDC of the cylinder #4 and the top dead center #5TDC of the cylinder #5; therefore, the engine stopping range is the interval that starts from the #3TDC, passes through the #4TDC, and reaches #5TDC.

Here, assuming that "the range "1" designates the range of the crank angle numbers CRKNUMs "36" through "41", "the range "2" designates the range of the crank angle numbers CRKNUMs "41" through "52", and "the range "3" designates the range of the crank angle numbers CRKNUMs "52" through "60", the total engine stopping range is the range of the crank angle numbers CRKNUMs "36" through "60", which is the range obtained by combining the ranges "1" through "3". The crank angle range storage means provided in the idling stop control apparatus 3 stores the crank angle numbers CRKNUMs "36" through "60", as the engine stopping range.

In FIG. 15, if there is found "the recognition signal 1" after the engine is restarted, the engine stopping range corresponds to the range of the crank angle numbers CRKNUMs "36" through "41", which is "the range 1"; if there is found the recognition signal 1 after the engine is restarted, the crank angle number CRKNUM is "43". In this case, as represented in FIG. 11, the cylinders to which the fuel is firstly supplied after the engine is restarted is the cylinders "#5" and "#6" that are in the intake stroke during the interval corresponding to the crank angle numbers CRKNUMs "36" through "44", which is "the range 1"; the cylinders at which ignition can initially be set after the engine is restarted are the cylinder "#4" that comes into the power stroke after the recognition signal 1 is found and the cylinder "#5" and "#6" to which the fuel has been supplied. In such a manner as described above, the idling stop control apparatus 3 determines the cylinders "#5" and "#6" to which the fuel is firstly supplied after the engine is restarted, and firstly supplies the fuel to the cylinders "#5" and "#6" immediately after the engine is restarted; the initial ignition signal is supplied to any one of the cylinders "#4" through "#6" so that the engine is rapidly restarted.

In FIG. 15, if there is found "the recognition signal 2" after the engine is restarted, the engine stopping range corresponds to the range of the crank angle numbers CRKNUMs "41" through "52", which is "the range 2"; if there is firstly found the recognition signal 2 after the engine is restarted, the crank angle number CRKNUM is "55". In this case, if there is found "the recognition signal 2 after 6 or more teeth have passed" since the engine was restarted, it is suggested that the engine has stopped in the range of the crank angle numbers CRKNUMs "41" through "47" within "the range 2"; thus, as is clear from FIG. 11, the cylinder to which the fuel is firstly supplied after the engine is restarted is the cylinder "#6" that is in the intake stroke while the engine is in the stop mode; the cylinders at which ignition can initially be set after the engine is restarted are the cylinders "#5" and "#1" that come into the power stroke after the recognition signal 2 is found and the cylinder "#6" to which the fuel has been supplied. In such a manner as described above, the idling stop control apparatus 3 determines the cylinder "#6" to which the fuel is firstly supplied after the engine is restarted, and firstly supplies the fuel to the cylinder "#6" immediately after the engine is restarted; the initial ignition signal is supplied to any one of the cylinders "#5", "#6", and "#1" so that the engine is rapidly restarted.

In contrast, if there is found "the recognition signal 2 within 5 teeth" after the engine is restarted, it is suggested that the engine has stopped in the range of the crank angle numbers CRKNUMs "48" through "52" within "the range 2";

thus, as is clear from FIG. 11, the cylinders to which the fuel is firstly supplied after the engine is restarted are the cylinder "#6" and "#1" that are in the intake stroke while the engine is in the stop mode. The cylinders at which ignition can initially be set after the engine is restarted are the cylinder "#5" that comes into the power stroke after the recognition signal 2 is found and the cylinder "#6" and "#1" to which the fuel has been supplied. In such a manner as described above, the idling stop control apparatus 3 determines the cylinders "#6" and "#1" to which the fuel is firstly supplied after the engine is restarted, and firstly supplies the fuel to the cylinders "#6" and "#1" immediately after the engine is restarted; the initial ignition signal is supplied to any one of the cylinders "#5", "#6", and "#1" so that the engine is rapidly restarted.

Furthermore, in FIG. 15, if there is found "the recognition signal 3" after the engine is restarted, the engine stopping range corresponds to the range of the crank angle numbers CRKNUMs "52" through "60", which is "the range 3"; if there is firstly found the recognition signal 3 after the engine is restarted, the crank angle number CRKNUM is "67". In this case, as is clear from FIG. 11, the cylinder to which the fuel is firstly supplied after the engine is restarted is the cylinder "#1" that is in the intake stroke during the interval corresponding to the crank angle numbers CRKNUMs "52" through "60", which is "the range 3"; the cylinders at which ignition can initially be set after the engine is restarted are the cylinder "#6" that comes into the power stroke after the recognition signal 3 is found and the cylinder "#1" to which the fuel has been supplied. In such a manner as described above, the idling stop control apparatus 3 determines the cylinder "#1" to which the fuel is firstly supplied after the engine is restarted, and firstly supplies the fuel to the cylinder "#1" immediately after the engine is restarted; the initial ignition signal is supplied to any one of the cylinders "#6" and "#1" so that the engine is rapidly restarted.

Next, FIG. 16 is an explanatory table for explaining the operation of the internal combustion engine control system according to Embodiment 2 of the present invention; FIG. 16 represents how "three ranges in the engine stopping range", "the crank angle number CRKNUM at a time when the recognition signal is found", "the cylinder to which the fuel is firstly supplied", and "the cylinder that can initially be ignited" each change as the kind of "the recognition signal found after the engine has been restarted" changes, in the case where, immediately before the engine stops, the recognition signal 2 over the crank angle numbers CRKNUMs "52" through "55" is detected.

In the case where, immediately before the engine stops, the recognition signal 2 over the crank angle numbers CRKNUMs "52" through "55" is found, the engine stops after it vibrates between the top dead center #4TDC of the cylinder #4 and the top dead center #5TDC of the cylinder #5, or the engine inertially surpasses the top dead center #5TDC of the cylinder #5 and then stops after it vibrates between the top dead center #5TDC of the cylinder #5 and the top dead center #6TDC of the cylinder #6; therefore, the engine stopping range is the interval that starts from the #4TDC, passes through the #5TDC, and reaches #6TDC.

Here, assuming that "the range "1" designates the range of the crank angle numbers CRKNUMs "48" through "52", "the range "2" designates the range of the crank angle numbers CRKNUMs "52" through "63", and "the range "3" designates the range of the crank angle numbers CRKNUMs "63" through "0", the total engine stopping range is the range of the crank angle numbers CRKNUMs "48" through "0", which is the range obtained by combining the ranges "1" through "3". The crank angle range storage means provided in the idling stop control apparatus 3 stores the crank angle numbers CRKNUMs "48" through "0", as the engine stopping range.

In FIG. 16, if there is found "the recognition signal 2" after the engine is restarted, the engine stopping range corresponds to the range of the crank angle numbers CRKNUMs "48" through "52", which is "the range 1"; if there is found the recognition signal 2 after the engine is restarted, the crank angle number CRKNUM is "55". In this case, as represented in FIG. 11, the cylinders to which the fuel is firstly supplied after the engine is restarted are the cylinders "#1" and "#6" that are in the intake stroke during the interval corresponding to the crank angle numbers CRKNUMs "48" through "52", which is "the range 1"; the cylinders at which ignition can initially be set after the engine is restarted are the cylinder "#5" that comes into the power stroke after the recognition signal 2 is found and the cylinders "#1" and "#6" to which the fuel has been supplied. In such a manner as described above, the idling stop control apparatus 3 determines the cylinders "#1" and "#6" to which the fuel is firstly supplied after the engine is restarted, and firstly supplies the fuel to the cylinders "#1" and "#6" immediately after the engine is restarted; the initial ignition signal is supplied to any one of the cylinders "#5", "#6", and "#1" so that the engine is rapidly restarted.

In FIG. 16, if there is found "the recognition signal 3" after the engine is restarted, the engine stopping range corresponds to the range of the crank angle numbers CRKNUMs "52" through "63", which is "the range 2"; if there is firstly found the recognition signal 3 after the engine is restarted, the crank angle number CRKNUM is "67". In this case, if there is found "the recognition signal 3 after 5 or more teeth have passed" since the engine was restarted, it is suggested that the engine has stopped in the range of the crank angle numbers CRKNUMs "52" through "59" within "the range 2"; thus, as is clear from FIG. 11, the cylinder to which the fuel is firstly supplied after the engine is restarted is the cylinder "#1" that is in the intake stroke while the engine is in the stop mode; the cylinders at which ignition can initially be set after the engine is restarted are the cylinders "#6" and "#2" that come into the power stroke after the recognition signal 3 is found and the cylinder "#1" to which the fuel has been supplied. In such a manner as described above, the idling stop control apparatus 3 determines the cylinder "#1" to which the fuel is firstly supplied after the engine is restarted, and firstly supplies the fuel to the cylinder "#1" immediately after the engine is restarted; the initial ignition signal is supplied to any one of the cylinders "#6", "#1", and "#2" so that the engine is rapidly restarted.

In contrast, if there is found "the recognition signal 3 within 4 teeth" after the engine is restarted, it is suggested that the engine has stopped in the range of the crank angle numbers CRKNUMs "60" through "63" within "the range 2"; thus, as is clear from FIG. 11, the cylinders to which the fuel is firstly supplied after the engine is restarted are the cylinder "#1" and "#2" that are in the intake stroke while the engine is in the stop mode. The cylinders at which ignition can initially be set after the engine is restarted are the cylinder "#6" that comes into the power stroke after the recognition signal 3 is found and the cylinder "#1" and "#2" to which the fuel has been supplied. In such a manner as described above, the idling stop control apparatus 3 determines the cylinders "#1" and "#2" to which the fuel is firstly supplied after the engine is restarted, and firstly supplies the fuel to the cylinders "#1" and "#2" immediately after the engine is restarted; the initial ignition signal is supplied to any one of the cylinders "#6", "#1", and "#2" so that the engine is rapidly restarted.

Furthermore, in FIG. 16, if there is found "the recognition signal 1" after the engine is restarted, the engine stopping range corresponds to the range of the crank angle numbers CRKNUMs "63" through "0", which is "the range 3"; if there is firstly found the recognition signal 1 after the engine is restarted, the crank angle number CRKNUM is "7". In this case, as is clear from FIG. 11, the cylinder to which the fuel is firstly supplied after the engine is restarted is the cylinder "#2" that is in the intake stroke during the interval corresponding to the crank angle numbers CRKNUMs "63" through "0", which is "the range 3"; the cylinders at which ignition can initially be set after the engine is restarted are the cylinder "#1" that comes into the power stroke after the recognition signal 1 is found and the cylinder "#2" to which the fuel has been supplied. In such a manner as described above, the idling stop control apparatus 3 determines the cylinder "#2" to which the fuel is firstly supplied after the engine is restarted, and firstly supplies the fuel to the cylinder "#2" immediately after the engine is restarted; the initial ignition signal is supplied to any one of the cylinders "#1" and "#2" so that the engine is rapidly restarted.

Next, FIG. 17 is an explanatory table for explaining the operation of the internal combustion engine control system according to Embodiment 2 of the present invention; FIG. 17 represents how "three ranges in the engine stopping range", "the crank angle number CRKNUM at a time when the recognition signal is found", "the cylinder to which the fuel is firstly supplied", and "the cylinder that can initially be ignited" each change as the kind of "the recognition signal found after the engine has been restarted" changes, in the case where, immediately before the engine stops, the recognition signal 3 over the crank angle numbers CRKNUMs "63" through "67" is detected.

In the case where, immediately before the engine stops, the recognition signal 3 over the crank angle numbers CRKNUMs "63" through "67" is found, the engine stops after it vibrates between the top dead center #5TDC of the cylinder #5 and the top dead center #6TDC of the cylinder #6, or the engine inertially surpasses the top dead center #6TDC of the cylinder #6 and then stops after it vibrates between the top dead center #6TDC of the cylinder #6 and the top dead center #1TDC of the cylinder #1; therefore, the engine stopping range is the interval that starts from the #5TDC, passes through the #6TDC, and reaches #1TDC.

Here, assuming that "the range "1" designates the range of the crank angle numbers CRKNUMs "60" through "63", "the range "2" designates the range of the crank angle numbers CRKNUMs "63" through "5", and "the range "3" designates the range of the crank angle numbers CRKNUMs "5" through "12", the total engine stopping range is the range of the crank angle numbers CRKNUMs "60" through "12", which is the range obtained by combining the ranges "1" through "3". The crank angle range storage means provided in the idling stop control apparatus 3 stores the crank angle numbers CRKNUMs "60" through "12", as the engine stopping range.

In FIG. 17, if there is found "the recognition signal 3" after the engine is restarted, the engine stopping range corresponds to the range of the crank angle numbers CRKNUMs "60" through "63", which is "the range 1"; if there is found the recognition signal 3 after the engine is restarted, the crank angle number CRKNUM is "67". In this case, as represented in FIG. 11, the cylinders to which the fuel is firstly supplied after the engine is restarted are the cylinders "#1" and "#2" that are in the intake stroke during the interval corresponding to the crank angle numbers CRKNUMs "60" through "63", which is "the range 1"; the cylinders at which ignition can initially be set after the engine is restarted are the cylinder "#6" that comes into the power stroke after the recognition signal 3 is found and the cylinders "#1" and "#2" to which the fuel has been supplied. In such a manner as described above, the idling stop control apparatus 3 determines the cylinders "#1" and "#2" to which the fuel is firstly supplied after the engine is restarted, and firstly supplies the fuel to the cylinders "#1" and "#2" immediately after the engine is restarted; the initial ignition signal is supplied to any one of the cylinders "#6", "#1", and "#2" so that the engine is rapidly restarted.

In FIG. 17, if there is found "the recognition signal 1" after the engine is restarted, the engine stopping range corresponds to the range of the crank angle numbers CRKNUMs "63" through "5", which is "the range 2"; if there is firstly found the recognition signal 1 after the engine is restarted, the crank angle number CRKNUM is "7". In this case, if there is found "the recognition signal 1 after 7 or more teeth have passed" since the engine was restarted, it is suggested that the engine has stopped in the range of the crank angle numbers CRKNUMs "63" through "71" within "the range 2"; thus, as is clear from FIG. 11, the cylinder to which the fuel is firstly supplied after the engine is restarted is the cylinder "#2" that is in the intake stroke while the engine is in the stop mode; the cylinders at which ignition can initially be set after the engine is restarted are the cylinders "#1" and "#3" that come into the power stroke after the recognition signal 1 is found and the cylinder "#2" to which the fuel has been supplied. In such a manner as described above, the idling stop control apparatus 3 determines the cylinder "#2" to which the fuel is firstly supplied after the engine is restarted, and firstly supplies the fuel to the cylinder "#2" immediately after the engine is restarted; the initial ignition signal is supplied to any one of the cylinders "#1" through "#3" so that the engine is rapidly restarted.

In contrast, if there is found "the recognition signal 1 within 6 teeth" after the engine is restarted, it is suggested that the engine has stopped in the range of the crank angle numbers CRKNUMs "0" through "5" within "the range 2"; thus, as is clear from FIG. 11, the cylinders to which the fuel is firstly supplied after the engine is restarted are the cylinder "#2" and "#3" that are in the intake stroke while the engine is in the stop mode. The cylinders at which ignition can initially be set after the engine is restarted are the cylinder "#1" that comes into the power stroke after the recognition signal 1 is found and the cylinder "#2" and "#3" to which the fuel has been supplied. In such a manner as described above, the idling stop control apparatus 3 determines the cylinders "#2" and "#3" to which the fuel is firstly supplied after the engine is restarted, and firstly supplies the fuel to the cylinders "#2" and "#3" immediately after the engine is restarted; the initial ignition signal is supplied to any one of the cylinders "#1" through "#3" so that the engine is rapidly restarted.

Furthermore, in FIG. 17, if there is found "the recognition signal 2" after the engine is restarted, the engine stopping range corresponds to the range of the crank angle numbers CRKNUMs "5" through "12", which is "the range 3"; if there is firstly found the recognition signal 2 after the engine is restarted, the crank angle number CRKNUM is "19". In this case, as is clear from FIG. 11, the cylinder to which the fuel is firstly supplied after the engine is restarted is the cylinder "#3" that is in the intake stroke during the interval corresponding to the crank angle numbers CRKNUMs "5" through "12", which is "the range 3"; the cylinders at which ignition can initially be set after the engine is restarted are the cylinder "#2" that comes into the power stroke after the recognition signal 2 is found and the cylinder "#3" to which the fuel has been supplied. In such a manner as described above, the idling stop control apparatus 3 determines the cylinder "#3" to which the fuel is firstly supplied after the engine is restarted, and firstly supplies the fuel to the cylinder "#3" immediately after the engine is restarted; the initial ignition signal is supplied to the cylinder "#2" or the cylinder "#3" so that the engine is rapidly restarted.

In the internal combustion engine control system, configured as described above, according to Embodiment 2 of the present invention, while the idling stop is performed, no special control of the engine 7 is implemented; therefore, the piston stops in the engine stopping range represented in FIGS. 11 and 12 or in the engine stopping range explained with reference to FIGS. 13 and 17. When the engine is restarted after the idling stop, the idling stop control apparatus 3 injects the fuel into the cylinder, explained with reference to FIGS. 12 through 17, that is in the intake stroke; then, by use of the crank angle signal D from the crank angle sensor 6 and the respective crank angles, of the recognition signal 1, the recognition signal 2, and the recognition signal 3, stored when the idling stop is performed, the idling stop control apparatus 3 rapidly determines the respective piston positions of the cylinders, i.e., performs cylinder discrimination and then starts ignition for the cylinder that has been supplied with the fuel.

In FIG. 8, described above, in response to the crank angle signal from the crank angle sensor 6, the idling stop control apparatus 3 stores the respective crank angle numbers CRKNUMs of the recognition signal 1, the recognition signal 2, and the recognition signal 3 at a time immediately before the stoppage of the engine (the step 100); furthermore, in response to the crank angle signal from the crank angle sensor 6, the idling stop control apparatus 3 discriminates among the kinds of the recognition signals at a time immediately after the restart of the engine, i.e., discriminates among the recognition signal 1, the recognition signal 2, and the recognition signal 3 (the step 200). Then, the engine stopping range is divided into the three ranges, i.e., "the range 1", "the range 2", and "the range 3" so that the crank angle at a time when the engine is stopped is calculated, i.e., the cylinder discrimination is performed (the step 300), and when the restarting of the engine begins (the step 400), there is determined the cylinder (the step 500) that has been supplied with the fuel, based on the cylinder discrimination (the step 300), and then the ignition signal is given to that cylinder.

There is represented no flowchart for explaining the idling stop control in Embodiment 2; however, by changing part of the flowcharts, in FIGS. 9A and 9B, for Embodiment 1 in accordance with the detailed explanation for Embodiment 2, there can be obtained a flowchart for Embodiment 2.

As described above, in the internal combustion engine control system according to Embodiment 2 of the present invention, the crank angle sensor is configured in such a way as to have recognition signals, the number of which is the maximum prime number, among the prime numbers included in the number of the engine cylinders, which is a divisor of the number of the cylinders, i.e., in such a way as to have 3 kinds of recognition signals; therefore, the crank angle sensor can be inexpensive. Moreover, control and calculation are simplified and the piston position at a time when the engine is restarted can be determined readily and inexpensively; therefore, ignition can securely be performed at the cylinder to which the fuel is initially supplied, whereby the engine can rapidly be restarted.

In addition, it goes without saying that the present invention can be applied also to engines other than a 4-cylinder engine and a 6-cylinder engine.

Embodiments 1 and 2 and the variant examples thereof described above are obtained by converting the present invention, described below, into tangible forms.

1. An internal combustion engine control system comprising:

a crank angle detection means that outputs a crank angle signal corresponding to a crank angle of an internal combustion engine having a plurality of cylinders;

a crank angle range storage means that stores a crank angle range at a time when the internal combustion engine stops, based on the crank angle signal; and a piston position determination means that determines the piston positions of the plurality of cylinders, based on the crank angle signal, wherein the crank angle detection means has a function of outputting respective recognition signals from a plurality of intermediate positions each flanked with the positions corresponding to the respective top dead centers of the pistons of the plurality of cylinders and differentiates the kinds of the respective recognition signals outputted from the adjacent intermediate positions;

wherein the piston position determination means determines the stopping position of the piston at a time when the internal combustion engine stops, based on the crank angle range stored in the crank angle range storage means and the crank angle corresponding to the position of the recognition signal outputted by the crank angle detection means; and wherein there is determined the cylinder to which a fuel is to be initially supplied when the internal combustion engine restarts, based on the stopping position of the piston determined by the piston position determination means.

2. Preferably, the number of kinds of the recognition signals corresponds to the divisor, which is the maximum prime number, among the divisors of the number of cylinders of the internal combustion engine.

3. Preferably, the crank angle range storage means is configured in such a way as to store, as the crank angle range at a time when the internal combustion engine stops, the range from the crank angle corresponding to the top dead center of the cylinder immediately before the recognition signal detected immediately before the internal combustion engine stops to the crank angle corresponding to the top dead center of the piston of the cylinder that is advanced from said cylinder by 2 cylinders.

4. Preferably, the piston position determination means is configured in such a way as to calculate a crank angle, by dividing the crank angle range stored in the crank angle range storage means into three ranges, i.e., a first range from the starting point of the stored crank angle range to the starting point of a first recognition signal that emerges firstly, a second range from the starting point of the first recognition signal to the starting point of the second recognition signal that emerges following the first recognition signal, and a third range from the starting point of the second recognition signal to the rear end of the stored crank angle range, and to determine the stopping position of the piston at a time when the internal combustion engine stops, based on at least one of the first range, the second range, and the third range and the crank angle corresponding to the position of the recognition signal outputted by the angle detection means.

Various modifications and alterations of this invention will be apparent to those skilled in the art without departing from the scope and spirit of this invention, and it should be understood that this is not limited to the illustrative embodiments set forth herein.

What is claimed is:

1. An internal combustion engine control system comprising:

a crank angle detection means that outputs a crank angle signal corresponding to a crank angle of an internal combustion engine having a plurality of cylinders;

a crank angle range storage means that stores a crank angle range at a time when the internal combustion engine stops, based on the crank angle signal; and a piston position determination means that determines the piston positions of the plurality of cylinders, based on the crank angle signal, wherein the crank angle detection means has a function of outputting respective recognition signals from a plurality of intermediate positions each flanked with the positions corresponding to the respective top dead centers of the pistons of the plurality of cylinders and differentiates the kinds of the respective recognition signals outputted from the adjacent intermediate positions;

wherein the piston position determination means determines the stopping position of the piston at a time when the internal combustion engine stops, based on the crank angle range stored in the crank angle range storage means and the crank angle corresponding to the position of the recognition signal outputted by the crank angle detection means; and wherein a cylinder to which a fuel is to be initially supplied when the internal combustion engine restarts is determined, based on the stopping position of the piston determined by the piston position determination means.

2. The internal combustion engine control system according to claim 1, wherein the number of kinds of the recognition signals corresponds to the divisor, which is the maximum prime number, among the divisors of the number of cylinders of the internal combustion engine.

3. The internal combustion engine control system according to claim 1, wherein the crank angle range storage means stores, as the crank angle range at a time when the internal combustion engine stops, the range from the crank angle corresponding to the top dead center of the cylinder immediately before the recognition signal detected immediately before the internal combustion engine stops to the crank angle corresponding to the top dead center of the piston of the cylinder that is advanced from said cylinder by 2 cylinders.

4. The internal combustion engine control system according to claim 1, wherein the piston position determination means calculates a crank angle, by dividing the crank angle range stored in the crank angle range storage means into three ranges, a first range from the starting point of the stored crank angle range to the starting point of a first recognition signal that emerges firstly, a second range from the starting point of the first recognition signal to the starting point of the second recognition signal that emerges following the first recognition signal, and a third range from the starting point of the second recognition signal to the rear end of the stored crank angle range, and determines the stopping position of the piston at a time when the internal combustion engine stops, based on at least one of the first range, the second range, and the third range and the crank angle corresponding to the position of the recognition signal outputted by the crank angle detection means.

5. An internal combustion engine control system comprising:

a crank angle detection unit that outputs a crank angle signal corresponding to a crank angle of an internal combustion engine having a plurality of cylinders;

a crank angle range storage unit that stores a crank angle range at a time when the internal combustion engine stops, based on the crank angle signal; and a piston position determination unit that determines the piston positions of the plurality of cylinders, based on the crank angle signal, wherein the crank angle detection unit has a function of outputting respective recognition signals from a plurality of intermediate positions each flanked with the positions corresponding to the respective top dead centers of the pistons of the plurality of cylinders and differentiates the kinds of the respective recognition signals outputted from the adjacent intermediate positions;

wherein the piston position determination unit determines the stopping position of the piston at a time when the internal combustion engine stops, based on the crank angle range stored in the crank angle range storage unit and the crank angle corresponding to the position of the recognition signal outputted by the crank angle detection unit; and wherein a cylinder to which a fuel is to be initially supplied when the internal combustion engine restarts is determined, based on the stopping position of the piston determined by the piston position determination unit.

6. The internal combustion engine control system according to claim 5, wherein the number of kinds of the recognition signals corresponds to the divisor, which is the maximum prime number, among the divisors of the number of cylinders of the internal combustion engine.

7. The internal combustion engine control system according to claim 5, wherein the crank angle range storage unit stores, as the crank angle range at a time when the internal combustion engine stops, the range from the crank angle corresponding to the top dead center of the cylinder immediately before the recognition signal detected immediately before the internal combustion engine stops to the crank angle corresponding to the top dead center of the piston of the cylinder that is advanced from said cylinder by 2 cylinders.

8. The internal combustion engine control system according to claim 5, wherein the piston position determination unit calculates a crank angle, by dividing the crank angle range stored in the crank angle range storage unit into three ranges, a first range from the starting point of the stored crank angle range to the starting point of a first recognition signal that emerges firstly, a second range from the starting point of the first recognition signal to the starting point of the second recognition signal that emerges following the first recognition signal, and a third range from the starting point of the second recognition signal to the rear end of the stored crank angle range, and determines the stopping position of the piston at a time when the internal combustion engine stops, based on at least one of the first range, the second range, and the third range and the crank angle corresponding to the position of the recognition signal outputted by the crank angle detection unit.

* * * * *